US011963622B2

(12) United States Patent
O'Mara et al.

(10) Patent No.: US 11,963,622 B2
(45) Date of Patent: Apr. 23, 2024

(54) LIGHTWEIGHT DETACHABLE CHILD CARRIER

(71) Applicant: Trail Magik LLC, Capistrano Beach, CA (US)

(72) Inventors: Katie O'Mara, Capistrano Beach, CA (US); Connor O'Mara, Capistrano Beach, CA (US)

(73) Assignee: Trail Magik LLC, Capistrano Beach, CA (US)

( * ) Notice: Subject to any disclaimer, the term of this patent is extended or adjusted under 35 U.S.C. 154(b) by 1 day.

(21) Appl. No.: 17/686,096

(22) Filed: Mar. 3, 2022

(65) Prior Publication Data

US 2022/0279937 A1 Sep. 8, 2022

Related U.S. Application Data

(60) Provisional application No. 63/156,632, filed on Mar. 4, 2021.

(51) Int. Cl.
*A47D 13/02* (2006.01)
*A45F 3/04* (2006.01)

(52) U.S. Cl.
CPC ..... *A47D 13/025* (2013.01); *A45F 3/04* (2013.01)

(58) Field of Classification Search
CPC ..... A47D 13/025
USPC ..... 224/158–161; D3/213, 214
See application file for complete search history.

(56) References Cited

U.S. PATENT DOCUMENTS 4,469,259 A * 9/1984 Krich ..... A47D 13/025 224/159
4,778,091 A * 10/1988 Barto ..... A47D 13/025 224/159
5,641,200 A * 6/1997 Howell ..... B62B 3/144 280/33.993
6,209,768 B1 4/2001 Boaz
6,289,534 B1 * 9/2001 Hakamiun ..... A61G 7/1067 5/89.1
6,889,882 B1 * 5/2005 Leep ..... A45F 3/14 224/160
7,322,498 B2 1/2008 Frost
7,766,199 B1 * 8/2010 Caperon ..... A47D 13/025 224/159
8,590,757 B2 11/2013 Frost
9,022,260 B2 5/2015 Frost
9,185,993 B2 11/2015 Telford et al.

(Continued)

FOREIGN PATENT DOCUMENTS

WO 2006079724 A1 8/2006
WO WO-2006079724 A1 * 8/2006 ..... A41B 13/06

OTHER PUBLICATIONS

English Translation of WO 2006079724 from the EPO website. (Year: 2006).*

(Continued)

*Primary Examiner* — Scott T McNurlen
(74) *Attorney, Agent, or Firm* — Seager, Tufte & Wickhem LLP

(57) ABSTRACT

Child carrier which is configured to be releasably and removably secured to a backpack worn by another person. The child carrier may be lightweight and collapsible such that it is easily stored when not in use. The child carrier may be configured to be worn on a front of a person's body while the backpack is worn on the back.

11 Claims, 13 Drawing Sheets

(56) References Cited

U.S. PATENT DOCUMENTS

| | | | | |
|---|---|---|---|---|
| 9,220,352 | B2 | 12/2015 | Frost | |
| 9,380,887 | B2 | 7/2016 | Frost | |
| 9,380,888 | B2 | 7/2016 | Telford et al. | |
| 9,700,152 | B2 | 7/2017 | Telford et al. | |
| 9,713,391 | B2 | 7/2017 | Telford et al. | |
| 9,839,302 | B2 | 12/2017 | Frost | |
| 9,955,797 | B2 | 5/2018 | Telford et al. | |
| 10,085,544 | B2 * | 10/2018 | Schessel | A45F 5/00 |
| 10,159,357 | B2 | 12/2018 | Frost | |
| 10,172,478 | B2 | 1/2019 | Telford et al. | |
| 10,426,275 | B2 | 10/2019 | Telford | |
| 10,506,885 | B2 | 12/2019 | Telford et al. | |
| 10,736,436 | B2 | 8/2020 | Telford | |
| 11,026,521 | B2 | 6/2021 | Telford et al. | |
| 11,051,634 | B2 | 7/2021 | Telford | |
| 11,141,003 | B1 | 10/2021 | Schumaker | |
| 11,219,317 | B2 | 1/2022 | Telford | |
| 11,297,957 | B2 | 4/2022 | Telford | |
| 2003/0234267 | A1 * | 12/2003 | Spears | A63G 17/00<br>224/159 |
| 2012/0266350 | A1 * | 10/2012 | Zack | A47D 13/025<br>2/84 |
| 2020/0085175 | A1 | 3/2020 | Cotirla et al. | |
| 2020/0383495 | A1 * | 12/2020 | Sheldrick | A47D 13/025 |

OTHER PUBLICATIONS

Invitation to Pay Addl Fees dated Jul. 11, 2022 for International Application No. PCT/US2022/018765.
International Search Report and Written Opinion dated Jul. 11, 2022 for International Application No. PCT/US2022/018765.

* cited by examiner

LIGHTWEIGHT DETACHABLE CHILD CARRIER

CROSS REFERENCE TO RELATED APPLICATIONS

The present application claims the benefit of and priority to US Provisional Patent App. No. 63/156,632, filed Mar. 4, 2021, titled LIGHTWEIGHT DETACHABLE CHILD CARRIER, the disclosure of which is incorporated herein by reference.

TECHNICAL FIELD

The disclosure is directed to generally to lightweight child carriers. More particularly, this disclosure is directed towards lightweight child carriers that are removably secured to a backpack.

BACKGROUND

In general, there are many types of infant and/or child carriers. For example, some carriers include long lengths of fabric meant to wrap around the body. Other carriers may include straps similar to a backpack and include a padded portion for supporting the child. In yet other examples, some child carriers include metallic frames along with a padded portion for the child. However, these child carriers may be large and bulky which may make transporting the child carrier when not in use cumbersome. Further, these child carriers may be difficult and/or time consuming to place the child in. What may be desirable is a lightweight child carrier which is easy to carry when not in use.

SUMMARY

The disclosure is directed to several alternative designs for a child carrier.

In a first example, a child carrier may comprise a body portion extending from a top end to a bottom end and between a first lateral side and a second lateral side, a first upper strap assembly fixedly secured to the top end of the body portion adjacent to the first lateral side, the first upper strap assembly configured to be releasably secured to a first backpack strap, a second upper strap assembly fixedly secured to the top end of the body portion adjacent to the second lateral side, the second upper strap assembly configured to be releasably secured to a second backpack strap, a first lower strap assembly fixedly secured to the bottom end of the body portion adjacent to the first lateral side, the first lower strap assembly configured to be releasably secured to the first backpack strap, and a second lower strap assembly fixedly secured to the top end of the body portion adjacent to the second lateral side, the second lower strap assembly configured to be releasably secured to the second backpack strap.

Alternatively or additionally to any of the examples above, in another example, each of the first upper strap assembly and the second upper strap assembly may comprise a first strap portion secured to the top end of the body portion, a buckle having an insertion end and a hook end configured to be releasably secured within the insertion end, the insertion end secured to the first strap portion, and a second strap portion having a first end fixedly secured relative to the body portion and a second end movably secured to the hook end of the buckle.

Alternatively or additionally to any of the examples above, in another example, a length of the second strap portion may be adjustable.

Alternatively or additionally to any of the examples above, in another example, when the hook end of the buckled is secured within the insertion end of the buckle, the second strap portion may form a loop.

Alternatively or additionally to any of the examples above, in another example, the loop may be configured to be wrapped around an upper shoulder strap adjuster of a backpacking backpack.

Alternatively or additionally to any of the examples above, in another example, the body portion may be formed from a heavy-duty fabric.

Alternatively or additionally to any of the examples above, in another example, each of the first lower strap assembly and the second lower strap assembly may comprise a first end secured to the bottom end of the body portion, a second end secured to a coupling mechanism, and a webbing slide.

Alternatively or additionally to any of the examples above, in another example, each of the first lower strap assembly and the second lower strap assembly may comprise a first end secured to the bottom end of the body portion, a second end spaced from the first end, a plurality of loops formed between the first end and the second end, and a coupling mechanism releasably secured to at least one of the plurality of loops.

Alternatively or additionally to any of the examples above, in another example, the coupling mechanism may comprise a carabiner.

Alternatively or additionally to any of the examples above, in another example, a length of the first and second lower strap assemblies may be adjustable.

Alternatively or additionally to any of the examples above, in another example, the first and second upper strap assemblies may be formed, at least in part, from a nylon web.

Alternatively or additionally to any of the examples above, in another example, the first and second lower strap assemblies may be formed, at least in part, from a nylon web.

Alternatively or additionally to any of the examples above, in another example, the child carrier may further comprise a first clamp removably coupled to the first upper strap assembly and a second clamp removably coupled to the second upper strap assembly.

Alternatively or additionally to any of the examples above, in another example, the first and second clamp may be configured to be secured to a first and a second backpack strap, respectively.

In another example, a child carrier may comprise a body portion formed from a heavy-duty fabric panel and extending from a top end to a bottom end and between a first lateral side and a second lateral side, a first upper strap assembly and a second upper strap assembly fixedly secured to the top end of the body portion adjacent to opposing lateral sides of the body portion, and a first lower strap assembly and a second lower strap assembly fixedly secured to the bottom end of the body portion adjacent to opposing lateral sides of the body portion. Each of the first upper strap assembly and the second upper strap assembly may comprise a first strap portion secured to the top end of the body portion, a buckle having an insertion end and a hook end configured to be releasably secured within the insertion end, the insertion end secured to the first strap portion, and a second strap portion having a first end fixedly secured relative to the body portion and a second end movably secured to the hook end of the buckle. Each of the first lower strap assembly and the second lower strap assembly may comprise a first end secured to the bottom end of the body portion, a second end secured to a coupling mechanism, and a webbing slide.

In another example, a child carrier may comprise a body portion formed from a heavy-duty fabric panel and extending from a top end to a bottom end and between a first lateral side and a second lateral side, a first upper strap assembly and a second upper strap assembly fixedly secured to the top end of the body portion adjacent to opposing lateral sides of the body portion, and a first lower strap assembly and a second lower strap assembly fixedly secured to the bottom end of the body portion adjacent to opposing lateral sides of the body portion. Each of the first upper strap assembly and the second upper strap assembly may comprise a first strap portion secured to the top end of the body portion, a buckle having an insertion end and a hook end configured to be releasably secured within the insertion end, the insertion end secured to the first strap portion, and a second strap portion having a first end fixedly secured relative to the body portion and a second end movably secured to the hook end of the buckle. Each of the first lower strap assembly and the second lower strap assembly may comprise a first end secured to the bottom end of the body portion, a second end spaced from the first end, a plurality of loops formed between the first end and the second end, and a coupling mechanism releasably secured to at least one of the plurality of loops.

Alternatively or additionally to any of the examples above, in another example, the first and second upper strap assemblies may be configured to be coupled to an upper portion of a first and a second backpack strap, respectively, and the first and second lower strap assemblies may be configured to be coupled to a lower portion of the first and the second backpack straps, respectively.

Alternatively or additionally to any of the examples above, in another example, the first lateral side and the second lateral side may each include a padded region adjacent to the bottom end.

In another example, a clamp assembly configured to be removably coupled to a strap may comprise an upper jaw including a plurality of teeth extending from a lower surface thereof, a lower jaw, a hinge assembly configured to pivotably couple the upper jaw and the lower jaw between an open configuration and a closed configuration, and a pivotable clasp configured to maintain the upper jaw and the lower jaw in the closed configuration.

Alternatively or additionally to any of the examples above, in another example, the clamp assembly may further comprise a protrusion defining an aperture extending upwards from an upper surface of the upper jaw.

Alternatively or additionally to any of the examples above, in another example, the clamp assembly may further comprise a cord extending through and secured to the aperture.

Alternatively or additionally to any of the examples above, in another example, the lower jaw may include a plurality of teeth extending from an upper surface thereof.

The above summary of some example embodiments is not intended to describe each disclosed embodiment or every implementation of the invention.

BRIEF DESCRIPTION OF THE DRAWINGS

The invention may be more completely understood in consideration of the following detailed description of various embodiments in connection with the accompanying drawings, in which.

Figure 1:
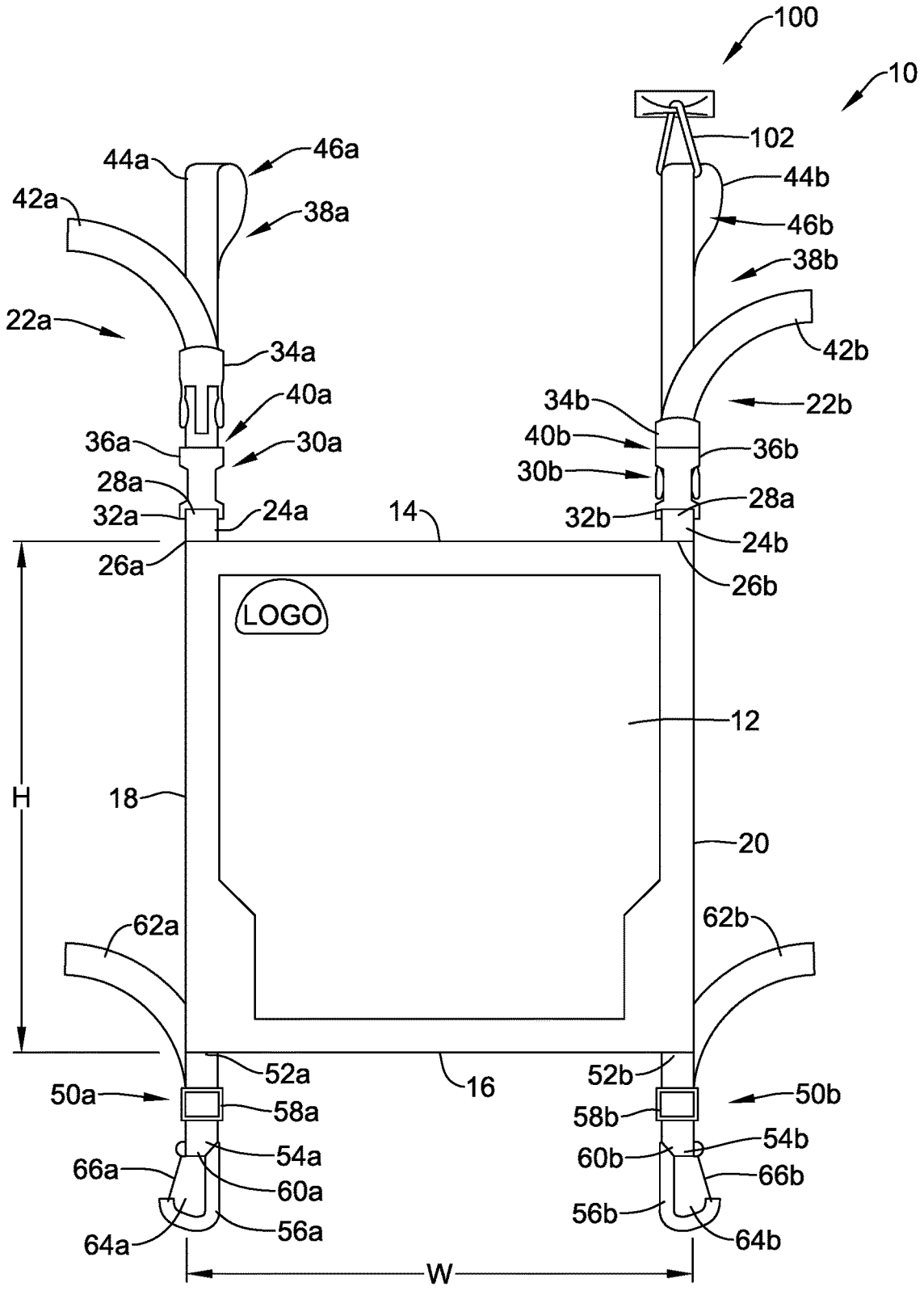
FIG. 1 is a front view of an illustrative child carrier.

While the invention is amenable to various modifications and alternative forms, specifics thereof have been shown by way of example in the drawings and will be described in detail. It should be understood, however, that the intention is not to limit aspects of the invention to the particular embodiments described. On the contrary, the intention is to cover all modifications, equivalents, and alternatives falling within the spirit and scope of the invention.

DETAILED DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

Although some suitable dimension ranges and/or values pertaining to various components, features and/or specifications are disclosed, one of skill in the art, incited by the present disclosure, would understand desired dimensions, ranges and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following detailed description should be read with reference to the drawings in which similar elements in different drawings are numbered the same. The detailed description and the drawings, which are not necessarily to scale, depict illustrative embodiments and are not intended to limit the scope of the invention. The illustrative embodiments depicted are intended only as exemplary. Selected features of any illustrative embodiment may be incorporated into an additional embodiment unless clearly stated to the contrary.

The present disclosure is directed towards a child carrier which is configured to be releasably and removably secured to a backpack worn by another person. The child carrier may be lightweight and collapsible (or foldable) such that it is easily stored when not in use. The child carrier may be configured to be worn on a front of a person's body while the backpack is worn on the back.

FIG. 1 is a front view of an illustrative child carrier 10. The child carrier 10 includes a flexible body portion or panel 12 extending from a top end 14 to a bottom end 16 and between a first lateral side 18 and a second lateral side 20. The body portion 12 may be substantially free from openings. The body portion 12 may have a generally square shape. However, this is not required. Other shapes may be used as desired. For example, a width W of the body portion 12 may be varied along a height H such that the width W is smaller adjacent the bottom end 16 than adjacent the top end 14. This is just one example. The shape may be varied as desired to accommodate a child's size. In some cases, the body portion 12 may have a width W that is in the range of about 10 inches (25.4 centimeters (cm)) to about 20 inches (50.8 cm), or about 15 inches (38.1 cm). In some cases, the body portion 12 may have a height H that is in the range of about 10 inches (25.4 centimeters (cm)) to about 20 inches (50.8 cm), or about 15 inches (38.1 cm). There are just examples; the width W and/or height H may be less than 10 inches (25.4 cm) or greater than 20 inches (50.8 cm), as desired. The child carrier 10 may be foldable or compressible such that it can be easily transported when not in use.

The body portion 12 may be formed from a heavy weight fabric, such as, but not limited to, canvas, denim, corduroy, ottoman fabric, upholstery fabric, wool, wool tweed, chenille, fleece, coated fabrics, etc. In some cases, the body portion 12 may be treated to be water resistant, waterproof, and/or abrasion resistant, etc. It is further contemplated that the body portion 12 may be formed from other materials, such as nylon, polyester, etc. In FIG. 1, the child carrier 10 is illustrated with a generally planar body portion 12 however, in use the bottom end 16 may curve underneath the child the support the bottom, as will be described in more detail herein. In some cases, the body portion 12 may be formed from a single unitary piece of fabric. In other cases, the body portion 12 may be formed from two or more pieces of fabric sewn together.

The body portion 12 include a first upper strap assembly 22*a* and a second upper strap assembly 22*b* (collectively, 22) fixedly secured to the top end 14 of the body portion 12. The first upper strap assembly 22*a* may be secured adjacent to the top end 14 adjacent to the first lateral side 18. While FIG. 1 illustrates the first upper strap assembly 22*a* as being in line with the first lateral side 18, this is not required. The first upper strap assembly 22*a* may be laterally offset from the first lateral side 18, as desired. Similarly, the second upper strap assembly 22*b* may be secured adjacent to the top end 14 adjacent to the second lateral side 20. While FIG. 1 illustrates the second upper strap assembly 22*b* as being in line with the second lateral side 20, this is not required. The second upper strap assembly 22*b* may be laterally offset from the second lateral side 20, as desired.

Each of the upper strap assemblies 22 may include a first strap portion 24*a*, 24*b* (collectively, 24) having a first end 26*a*, 26*b* (collectively, 26) secured to the body portion 12 and a second end 28*a*, 28*b* (collectively, 28) coupled to a buckle 30*a*, 30*b* (collectively, 30). The first strap portion 24 may have a length of material that is looped through an opening or slot 32*a*, 32*b* (collectively, 32) of the buckle 30 such that both free ends of the length are adjacent to the first end 26*a* of the first strap portion 24 and the second end 28 is movably coupled to the buckle 30. In some cases, the first end 26 (e.g., both free ends of the length of the material) of the first strap portion 24 may be sewn to the body portion 12, using, for example, heavy duty thread. In other cases, the first end 26 of the first strap portion 24 may be secured to the body portion 12 using other techniques, such as, but not limited to, fusible tape, fusible web, adhesives, rivets, etc. It is contemplated that more than one coupling mechanism may be used in combination to secure the upper strap assemblies 22 to the body portion 12.

The buckle 30 may be a side release buckle 30 having a first or hook end 34*a*, 34*b* (collectively, 34) and a second or an insertion end 36*a*, 36*b* (collectively, 36). The hook end 34 is releasably secured within the insertion end 36. In FIG. 1, the first buckle 30*a* is illustrated in an uncoupled configuration while the second buckle 30*b* is in the coupled configuration. While the buckle 30 is described as a side release buckle, other buckles or fastening mechanisms may be used as desired, such as, but not limited to, conventional belt buckles, clasps, etc.

The upper strap assemblies 22 may further include a second strap portion 38*a*, 38*b* (collectively, 38) extending from a first end 40*a*, 40*b* (collectively, 40) and a second end 42*a*, 42*b* (collectively, 42). In some examples, the first end 40 of the second strap portion 38 may be fixedly secured to the insertion end 36 of the buckle 30 (e.g., looped through the slot 32 and sewn to itself). In other examples, the first end 40 of the second strap portion 38 may be fixedly secured to the body portion 12. It is contemplated that when the first end 40 is secured to the body portion 12, the first end 40 may be sewn to the body portion 12 or attached using any of the other mechanisms described herein. The second end 42 may be movably secured to the hook end 34 of the buckle 30 and/or to an intermediate region 44*a*, 44*b* (collectively, 44) of the second strap portion 38 to shorten or lengthen the second strap portion 38. For example, the second end 42 may be movably secured to the intermediate region 44 via a tri-glide slide or a webbing slide to shorten or lengthen a length of the second strap portion 38.

When the hook end 34 is secured within the insertion end 36 of the buckle 30, the second strap portion 38 may form a loop 46*a*, 46*b* (collectively, 46). The loop 46 may be configured to be attached or wrapped around the upper shoulder strap adjuster of a backpacking backpack, as will be described in more detail herein, to releasably secure the child carrier 10 to the backpacking backpack.

In some cases, it may be desirable to couple the child carrier 10 to a backpack that does not include upper shoulder strap adjusters, such as, but not limited to a daypack. Optional and/or removable clamps or clasps 100 may be coupled to the loops 46 of the second strap portion 38 to secure the child carrier 10 to a strap of a daypack. While FIG. 1 illustrates a single clamp 100, it should be understood that a clamp 100 may be releasably secured to each of the second strap portions 38*a*, 38*b*. The clamp 100 may be releasably secured to the second strap portions 38 using a length of cord 102, such as but not limited to, paracord. For example, as will be described in more detail herein, the cord 102 may be secured to the clamp 100 and then secured within the loop 46, using, for example, a knot to tie the free ends. It is further contemplated that other mechanisms may be used to secure the clamp 100 to the child carrier 10. For example, as discussed with respect to FIG. 10, an insertion end of a side release buckle may be secured to the clamp to allow the insertion end to receive the hook end 34 of the buckle 30.

The body portion 12 include a first lower strap assembly 50*a* and a second lower strap assembly 50*b* (collectively, 50) fixedly secured to the bottom end 16 of the body portion 12. The first lower strap assembly 50*a* may be secured adjacent to the bottom end 16 adjacent to the first lateral side 18. While FIG. 1 illustrates the first lower strap assembly 50*a* as being in line with the first lateral side 18, this is not required. The first lower strap assembly 50*a* may be laterally offset from the first lateral side 18, as desired. Similarly, the second lower strap assembly 50*b* may be secured adjacent to the bottom end 16 adjacent to the second lateral side 20. While FIG. 1 illustrates the second lower strap assembly 50*b* as being in line with the second lateral side 20, this is not required. The second lower strap assembly 50*b* may be laterally offset from the second lateral side 20, as desired.

Each of the lower strap assemblies 50 may include a first end 52*a*, 52*b* (collectively, 52) secured to the bottom end 16 of the body portion 12 and a second end 54*a*, 54*b* (collectively, 54) coupled to a coupling mechanism 56*a*, 56*b* (collectively, 56), such as, but not limited to a carabiner clip. In some cases, the first end 52 of the lower strap assemblies 50 may be sewn to the body portion 12, using, for example, heavy duty thread. In other cases, the first end 52 of the lower strap assemblies 50 may be secured to the body portion 12 using other techniques, such as, but not limited to, fusible tape, fusible web, adhesives, rivets, etc. It is contemplated that more than one coupling mechanism may be used in combination to secure the lower strap assemblies 50 to the body portion 12. The lower strap assemblies 50 may be folded back on itself to create a loop 60*a*, 60*b* (collectively, 60) adjacent the second end 54 of the lower strap assemblies 50 and secured with a tri-glide slide or a webbing slide 58*a*, 58*b* (collectively, 58). The webbing slide 58 may be configured to adjust a length of the lower strap assemblies 50. For example, the lower strap assemblies 50 may include extra length 62*a*, 62*b* (collectively, 60) to allow the length to be adjusted. The coupling mechanism 56 may be configured to receive a portion of the loop 60 within a central opening 64*a*, 64*b* (collectively, 64) thereof. For example, the coupling mechanism 56 may include an articulatable portion 66*a*, 66*b* (collectively, 66) which is configured to deflect to allow the coupling mechanism to be clipped to various components. When the child carrier 10 is coupled to a backpacking backpack, daypack, or other backpack, the coupling mechanism 56 may also receive a portion of the backpack strap within the central opening 64.

The upper and/or lower strap assemblies 22, 50 may be formed, at least in part, from a nylon webbing strap. However, other webbing strap may be used as desired, including, but not limited to polypropylene, polyester, and/or Kevlar®. It is further contemplated that other heavy-duty fabrics, such as those described above, may be used in place of a webbing strap, if so desired. The upper and/or lower strap assemblies 22, 50 may have a width of about 1 inch (2.54 cm). However, the width can be less than 1 inch (2.54 cm) or greater than 1 inch (2.54 cm), as desired.

Figure 2:
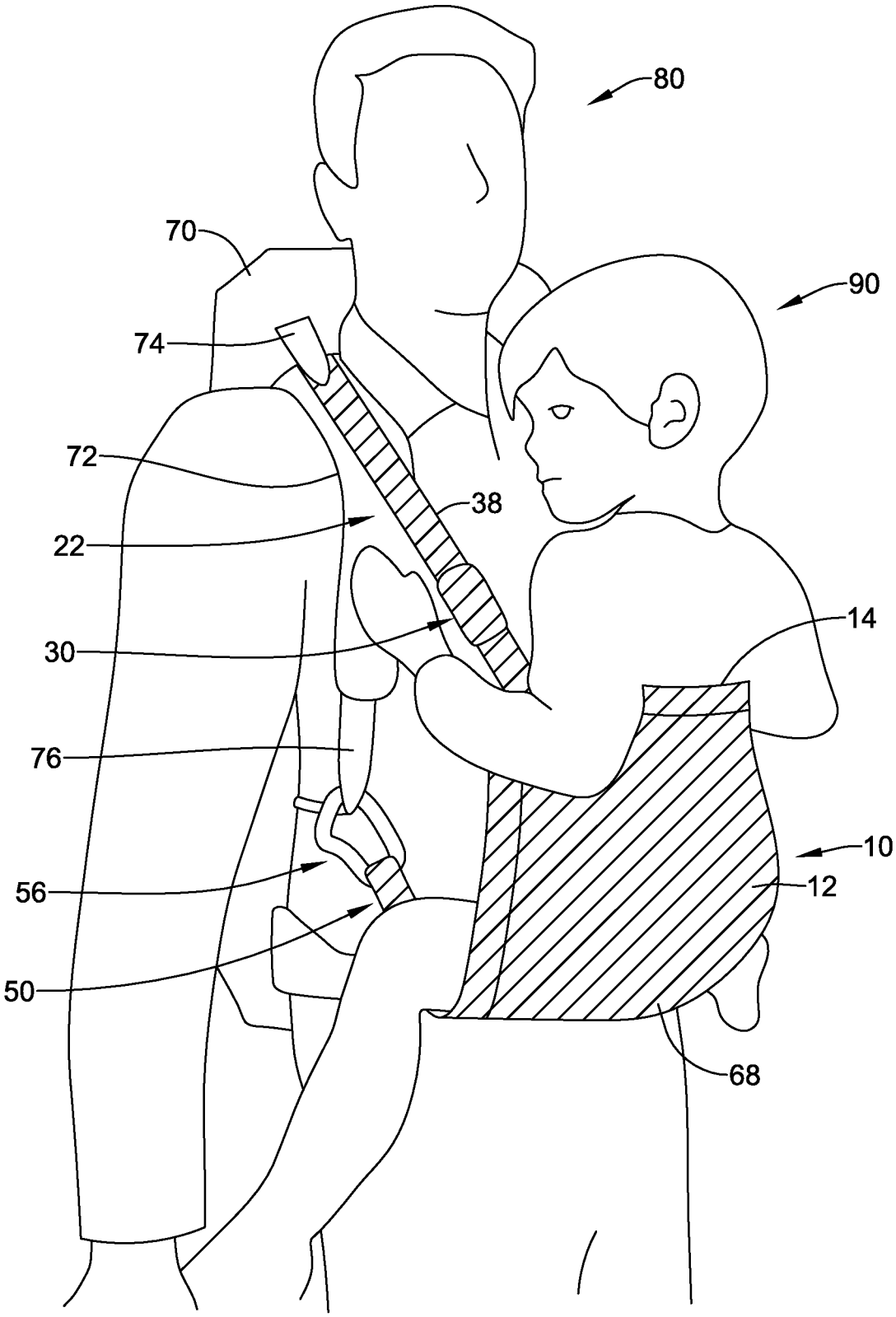
FIG. 2 is a schematic side view of the illustrative child carrier of FIG. 1.

FIG. 2 is a schematic side view of a child 90 carried the illustrative child carrier 10 coupled to a backpacking backpack 70 worn by a person 80. To couple the child carrier 10 to the backpacking backpack 70 the buckles 30 may be unbuckled to allow the hook end 34 to move freely. The hook end 34 may be wrapped around the upper shoulder strap adjuster 74 (shown in more detail with respect to FIG. 3) of the strap 72 of the backpacking backpack 70 adjacent to the wearer's shoulder. The hook end 34 may then be coupled with the insertion end 36 of the buckle 30 to secure each upper strap assembly 22 to the backpacking backpack 70. The looped portion 46 of each second strap portion 38 of the upper strap assembly 22 is disposed above the upper shoulder strap adjuster 74 such that the upper shoulder strap adjuster 74 acts as mechanical stop preventing downward movement of the child carrier 10. Similarly, the coupling mechanism 56 may be secured about a lower portion 76 of the strap 72 of the backpacking backpack 70 adjacent to the person's waist.

The length of the upper strap assemblies 22 and/or the length of the lower strap assemblies 50 may be increased or decreased to accommodate the size of the child 90 and/or the size of the person 80 carrying the child 90. In some cases, the length of the lower strap assembly 50 may be adjusted to bring the bottom end 16 of the body portion 12 closer to the wearer's body while the upper strap assembly 22 may be adjusted such that there is a gap between the wearer's body and the top end 14. It is contemplated that as the bottom end 16 of the body portion 12 of the child carrier 10 is drawn toward the body of the wearer 80, a seat region 68 is created to allow the bottom of the child 90 to rest therein. The legs of the child 90 may extend over the lower strap assemblies 50 to rest comfortably alongside the person 80 carrying the child 90. It is further contemplated that the body portion 12 supports the back of the child 90.

Figure 3:
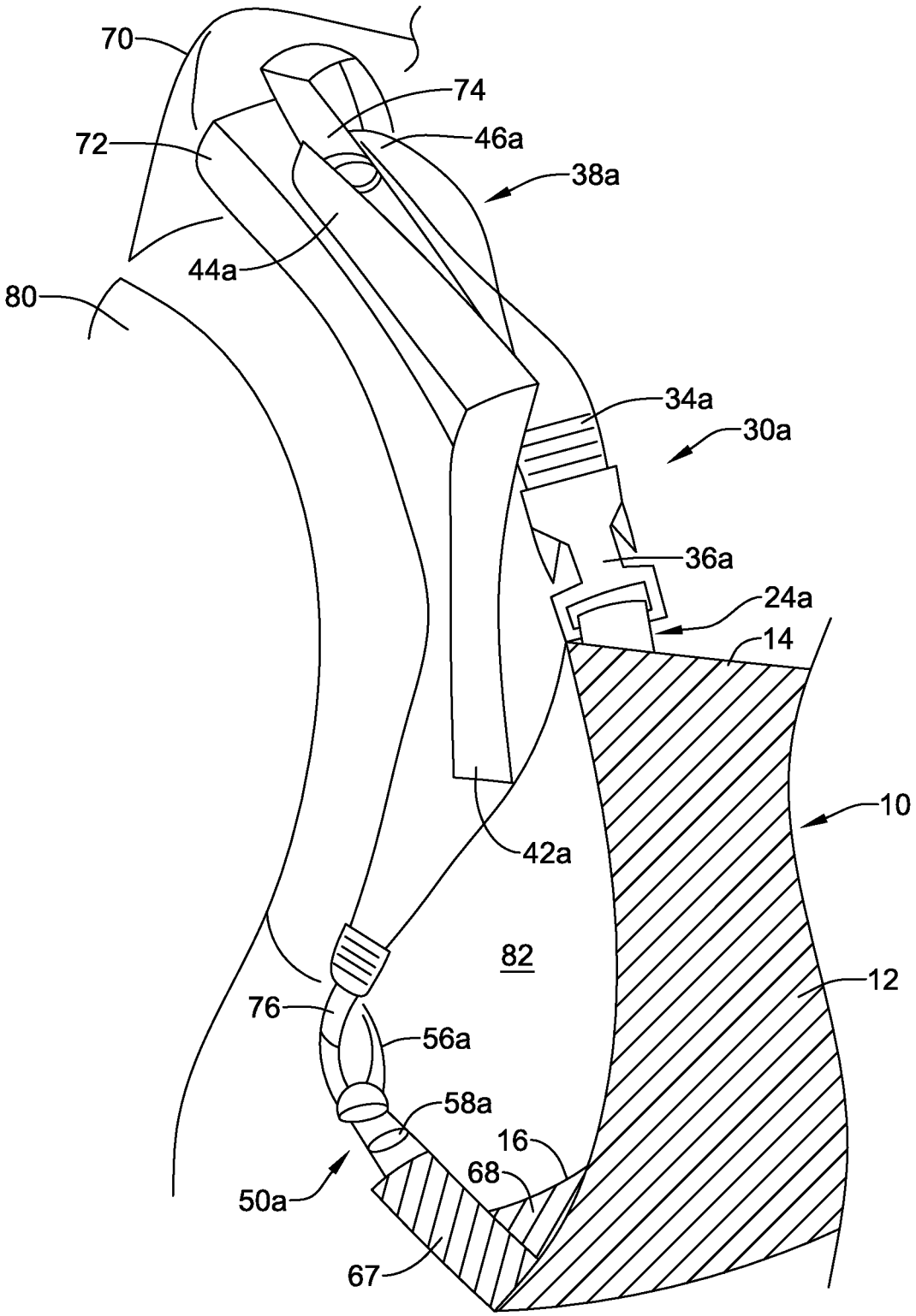
FIG. 3 is a partial perspective view of the child carrier of FIG. 1 coupled to a backpacking backpack worn by a person.

FIG. 3 is a partial perspective view of the illustrative child carrier 10 coupled to a backpacking backpack 70 worn by a person 80. As can be seen in FIG. 3, the second strap portion 38 of the upper strap assembly 22 wraps around the upper shoulder strap adjuster 74 at a location above where the upper shoulder strap adjuster 74 is secured to the strap 72 of the backpacking backpack 70 to create a secure and releasable attachment of the upper strap assemblies 22 to the backpacking backpack 70. The lower strap assemblies 50 are releasably secured to a lower portion 76 of the strap 72 of the backpacking backpack 70. As can be seen, the length of the lower strap assemblies 50 is adjusted to bring the bottom end 16 of the body portion close the wearer's body 82 to create a seat region 68. In some cases, the first and/or second lateral sides 18/20 may include a region of padding 67 adjacent to the bottom end 16 thereof. This may provide comfort to the child without substantially increasing the weight or bulk of the child carrier 10.

Figure 4:
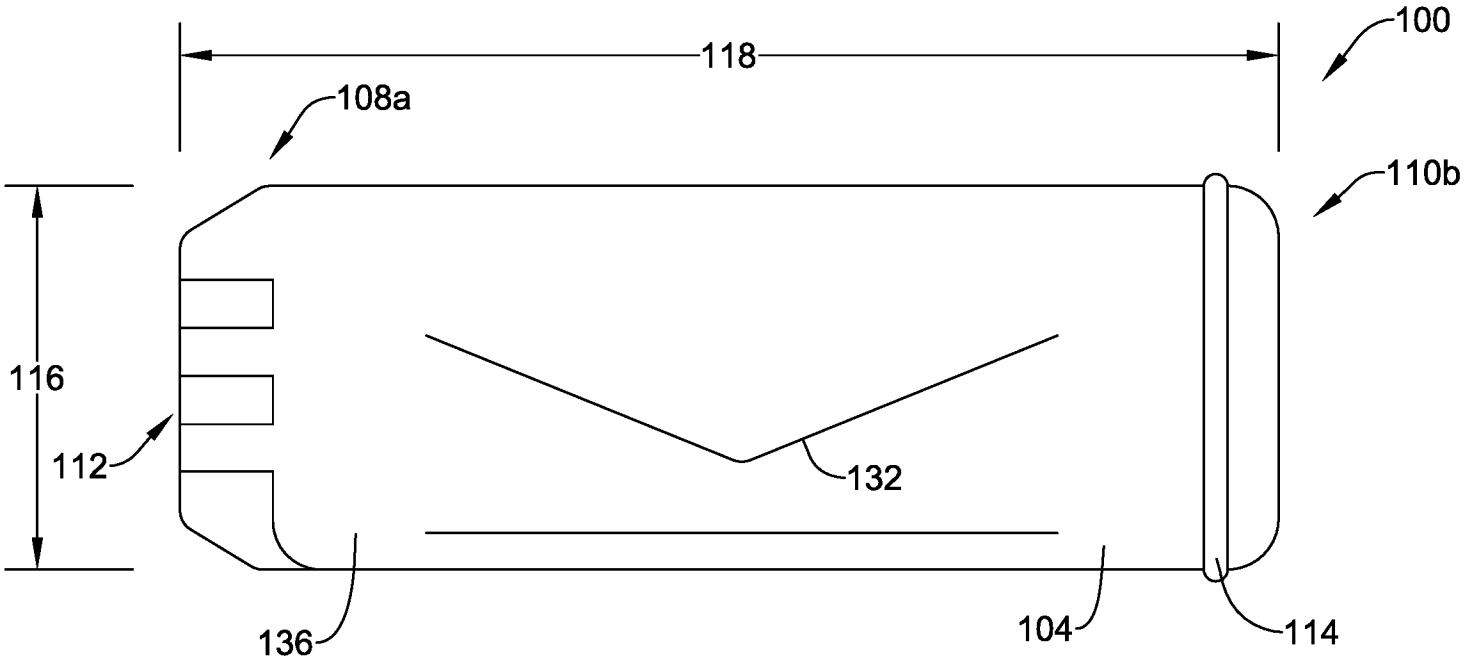
FIG. 4 is a top view of an illustrative clamp for use with a child carrier.
Figure 5:
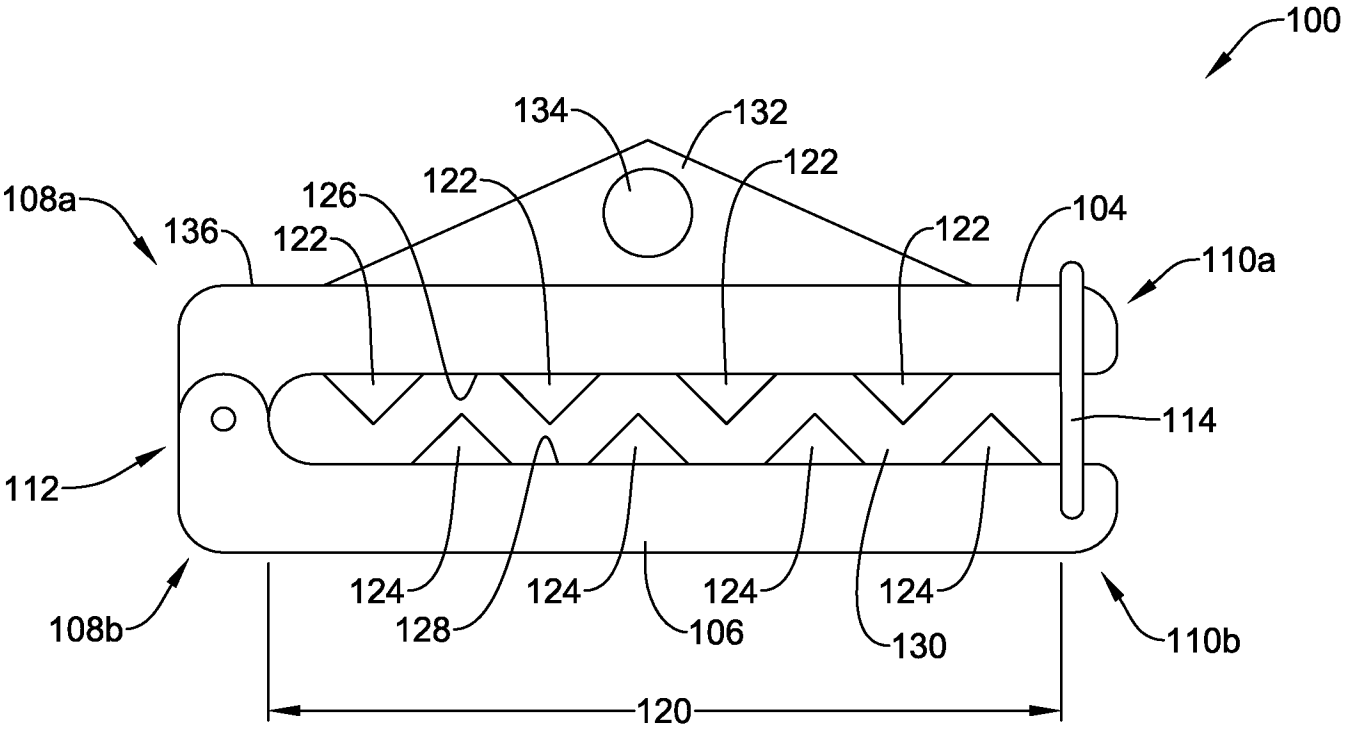
FIG. 5 is a side view of the illustrative clamp of FIG. 4 in a closed configuration.
Figure 6:
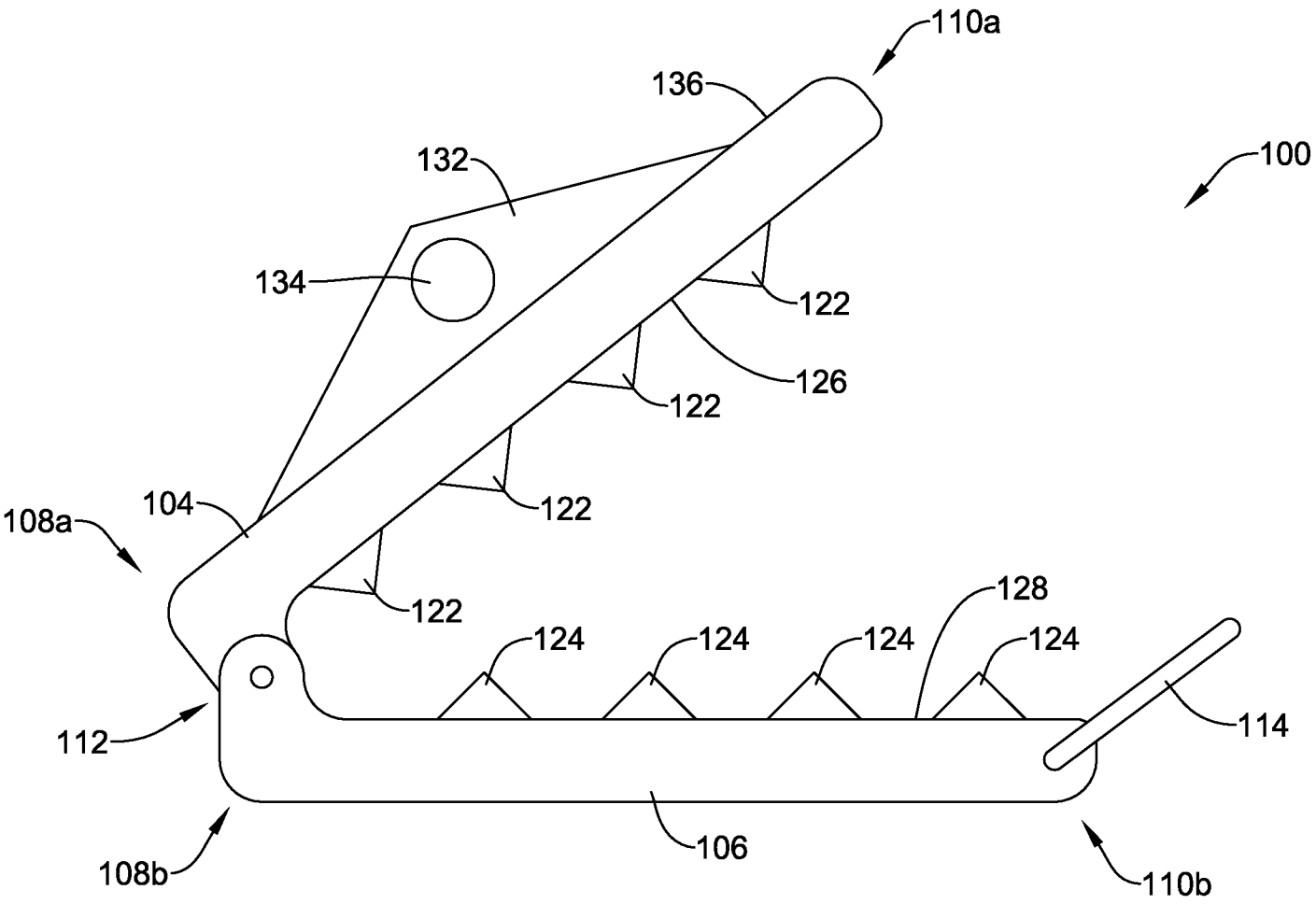
FIG. 6 is a side view of the illustrative clamp of FIG. 4 in an open configuration.

FIG. 4 is a top view of the illustrative strap clamp 100 that may be used to secure the child carrier 10 to a backpack that is free from an upper shoulder strap adjuster. FIG. 5 illustrates a side view of the illustrative clamp 100 of FIG. 4 in a closed configuration. FIG. 6 illustrates a side view of the illustrative clamp 100 of FIG. 4 in an open configuration. While the clamp 100 is described with respect to securing the child carrier 10 to a backpack, it is contemplated that the clamp 100 may be used to secure other accessory devices to a strap of a backpack (or other piece of equipment). For example, the clamp 100 may be used to secure accessories such as, but not limited to, water bottles, binoculars, cell phones, hiking gear, camping gear, etc.

Generally, the clamp 100 may include an upper jaw 104 and a lower jaw 106 having a width 116 and a length 118. The clamp 100 may have a generally rectangular shape, as illustrated. However, the clamp 100 may take any shape desired, including, but not limited to, circular or semi-circular, square, triangular, half-ovoid, polygonal, etc. In some cases, the width may be in the range of about 0.5 inches (1.27 cm) to about 1.5 inches (3.81 cm), or about 1 inch (2.54 cm). The length 118 may be in the range of about 2.5 (6.35 cm) inches to about 3.5 inches (8.89 cm) or about 3 inches (7.62 cm). The upper and lower jaws 104, 106 may have similar outer dimensions to provide a uniform outer surface. In some examples, the upper and/or lower jaws 104, 106 of the clamp 100 and/or the various components thereof may be made from a rigid material (e.g., plastic such as acrylonitrile butadiene styrene, thermoplastics, other polymers, hard rubber, metal, alloy, wood). Other examples may, however, include clamps 100 made from a flexible or semi-rigid material, such as plastic.

The upper jaw 104 and the lower jaw 106 may be pivotably coupled to one another adjacent a first end 108 thereof via a hinge assembly 112. The hinge assembly 112 may be a butt hinge, a spring-loaded hinge (configured to bias the clamp 100 in an open or closed configuration), a concealed hinge, an overlay hinge, a hidden barrel hinge, a knife hinge, a pin assembly, or other mechanism configured to pivotably couple the upper and lower jaws 104, 106. The second ends 110*a*, 110*b* (collectively, 110) of the upper and lower jaw 104, 106 may move away from one another to allow the lower jaw 106 to be positioned behind a backpack strap and the upper jaw 104 to be positioned along a front of the same backpack strap. When closed, the upper and lower jaws 104, 106 may define a cavity 130 configured to receive the backpack strap therein. The cavity 130 may have a length 120 that is less than the length 118 of the clamp 100. In some cases, the length 120 of the cavity 130 may be in the range of about of about 2 inches (5.08 cm) to about 3 inches (7.62 cm) or about 2.5 inches (6.35 cm).

The clamp 100 may further include a pivotable clasp 114 pivotably coupled to the lower jaw 106 adjacent the second end thereof 110*b*. The clasp 114 may have a shape which generally conforms to the perimeter of the clamp 100 in the closed configuration. In the illustrative embodiment, the clasp 114 may have a generally rectangular shape, although this is not required. A portion (e.g., a first edge) of the clasp 114 may be disposed within the lower jaw 106 and may extend through a width 116 of the lower jaw 106. A second, third, and fourth edge of the clasp 114 may be configured to be positioned along an outer surface of the upper and lower jaws 104, 106 when the clamp 100 is in the closed configuration. The clasp 114 may be selectively positionable over the upper jaw 104 (as shown in FIGS. 4 and 5) to maintain the clamp 100 in the closed configuration. In some cases, the upper jaw 104 may include a recess or groove configured to receive an edge of the clasp 114. This may provide a mechanical stop which reduces inadvertent movement of the clasp 114. The clasp 114 may be rotated away from the second end 110 as shown in FIG. 6 to allow the clamp 100 to be opened.

The clamp 100 may further include a first plurality of teeth or protrusions 122 extending from the upper jaw 104 and a second plurality of teeth or protrusion 124 extending from the lower jaw 106. The first plurality of teeth 122 may extend from a lower surface 126 of the upper jaw 104 towards the lower jaw 106 while the second plurality of teeth 124 may extend from an upper surface 128 of the lower jaw 106 towards the upper jaw 104. In some cases, each tooth of the first plurality of teeth 122 may be offset from each tooth of the second plurality of teeth 124. However, this is not required. It is contemplated that the first and/or second plurality of teeth 122, 124 may be arranged in any manner desired. For example, the first and/or second plurality of teeth 122, 124 may be arranged in one or more rows and/or one or more columns along the surfaces 126, 128 of the upper and lower jaws 104, 106. It is further contemplated that the first plurality of teeth 122 and the second plurality of teeth 124 may include a same number of individual teeth or a differing number of teeth, as desired. In some cases, only one of the first plurality of teeth or the second plurality of teeth 124 may be provided. While the first and second plurality of teeth 122, 124 are illustrated as having a triangular, conical or pyramidal shape, it is contemplated that the first and second plurality of teeth 122, 124 may take any shape desired. The first and second plurality of teeth 122, 124 may be configured to grip the fabric of a backpack strap without causing damage to the strap. In some cases, the first and second plurality of teeth 122, 124 may include combinations of teeth shapes and/or sizes.

Figure 7:
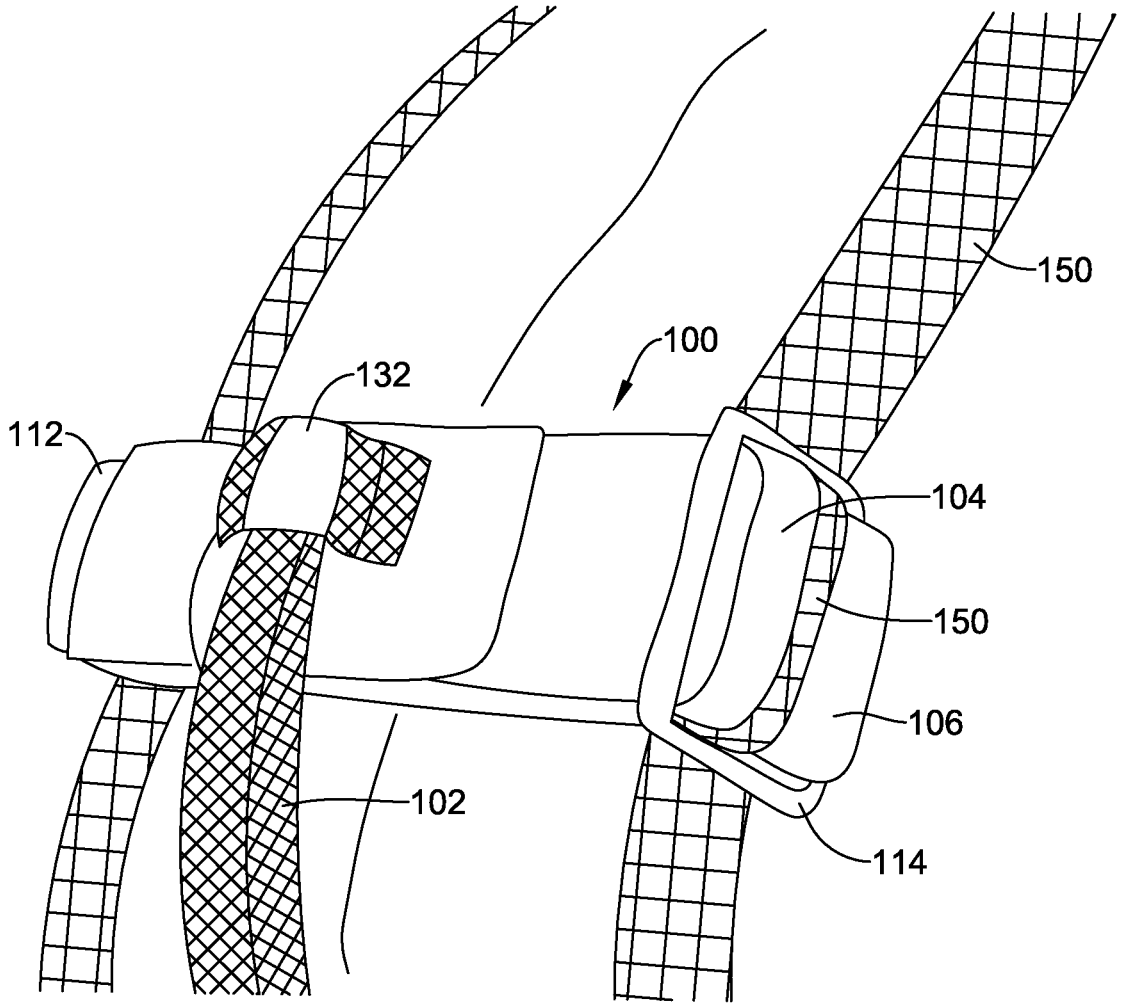
FIG. 7 is a perspective view of the illustrative clamp of FIG. 4 attached to a backpack strap.

The clamp 100 may additionally include a protrusion 132 extending upwardly from an upper surface 136 of the upper jaw 104. The protrusion 132 may define an aperture or opening 134 configured to receive the cord 102 for coupling the clamp 100 to the child carrier 10. Turning to FIG. 7 which illustrates a perspective view of the illustrative clamp 100 secured to a backpack strap 150, in some cases, the cord 102 may attached to the clamp 100 through the aperture 134 using a cow hitch or a lark's head knot. However, the cord 102 may be secured using other knots, as desired. As can be seen in FIG. 7, the clamp 100 is configured to pinch or otherwise secure the backpack strap 150 within the cavity 130 of the clamp 100. As shown in FIG. 7, a free end of the cord 102 is secured to the second strap portions 38 of the upper strap assemblies 22. This may allow the clamp 100 to function as the anchor to the backpack. For example, in lieu of the second strap portions 38 being disposed around upper shoulder strap adjuster of a backpacking backpack (as illustrated in FIG. 3), the second strap portions 38 are secured to the backpack strap 150 via the clamp 100 and cord 102. This may allow the child carrier 10 to be used with any style of backpack regardless of the presence of upper shoulder strap adjusters. In some cases, the clamp 100 may be omitted and the cord 102 secured directly to the backpack strap 150. For example, the cord 102 may be tied to the backpack strap 150 as well as the second strap portions 38 of the upper strap assemblies 22.

Figure 8:
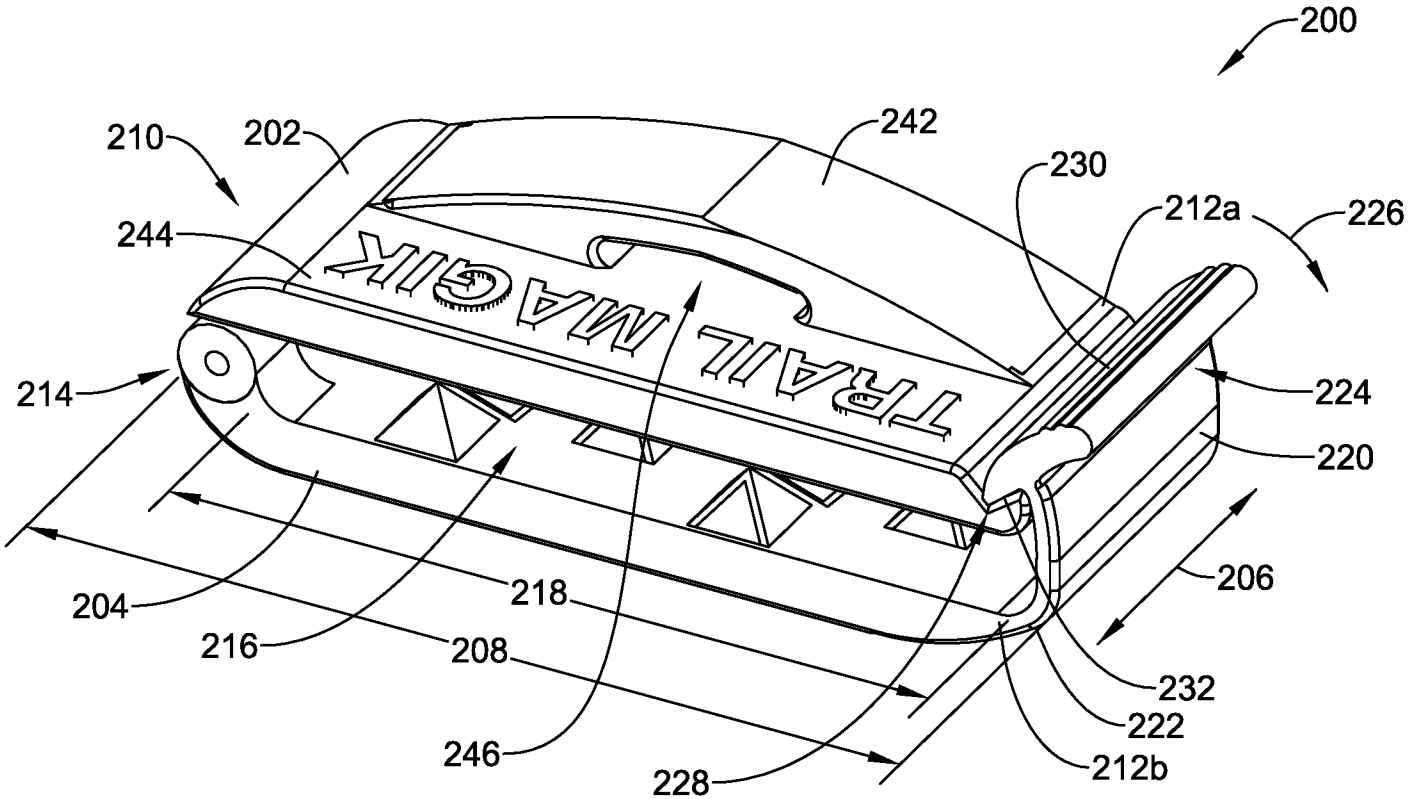
FIG. 8 is a perspective view of another illustrative clamp for use with a child carrier in a closed configuration.
Figure 9:
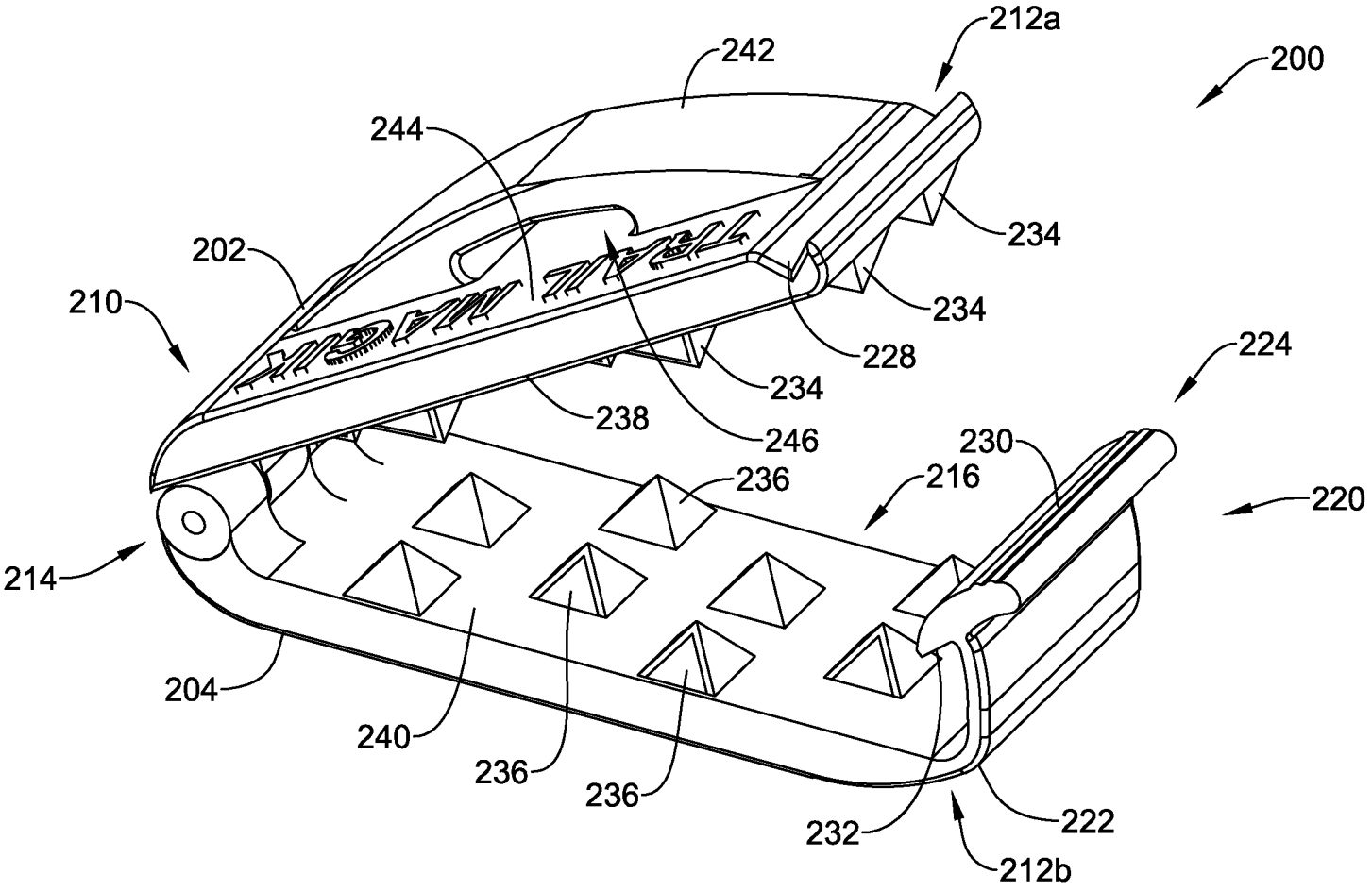
FIG. 9 is a perspective view of the illustrative clamp of FIG. 8 in an open configuration.
Figure 10:
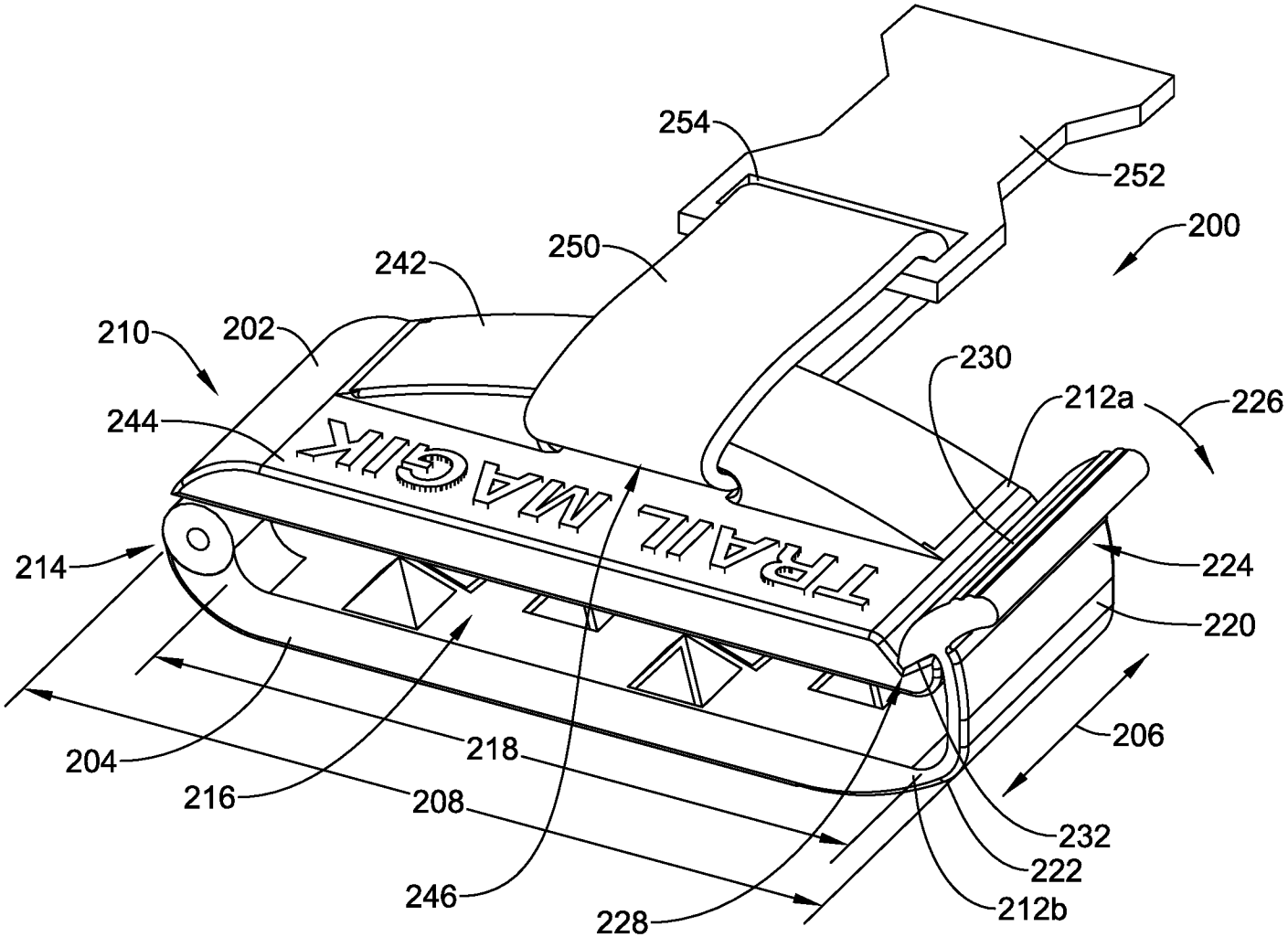
FIG. 10 is a perspective view of the illustrative clamp of FIG. 8 including an attachment mechanism.

FIG. 8 is a perspective view of another illustrative strap clamp 200 in a closed configuration that may be used to secure the child carrier 10 to a backpack that is free from an upper shoulder strap adjuster. FIG. 9 is a perspective view of the illustrative strap clamp 200 of FIG. 8 in an open configuration. FIG. 10 is a perspective view of the illustrative strap clamp 200 of FIG. 8 in closed configuration with an attachment mechanism. While the clamp 200 is described with respect to securing the child carrier 10 to a backpack, it is contemplated that the clamp 200 may be used to secure other accessory devices to a strap of a backpack (or other piece of equipment). For example, the clamp 200 may be used to secure accessories such as, but not limited to, water bottles, binoculars, cell phones, hiking gear, camping gear, etc.

Generally, the clamp 200 may include an upper jaw 202 and a lower jaw 204 having a width 206 and a length 208. The clamp 200 may have a generally rectangular shape, as illustrated. However, the clamp 200 may take any shape desired, including, but not limited to, circular or semi-circular, square, triangular, half-ovoid, polygonal, etc. In some cases, the width may be in the range of about 0.5 inches (1.27 cm) to about 1.5 inches (3.81 cm), or about 1 inch (2.54 cm). The length 208 may be in the range of about 2.5 (6.35 cm) inches to about 3.5 inches (8.89 cm) or about 3 inches (7.62 cm). The upper and lower jaws 202, 204 may have similar outer dimensions to provide a uniform outer surface. In some examples, the upper and/or lower jaws 202, 204 of the clamp 200 and/or the various components thereof may be made from a rigid material (e.g., plastic such as acrylonitrile butadiene styrene, thermoplastics, other polymers, hard rubber, metal, alloy, wood). Other examples may, however, include clamps 200 made from a flexible or semi-rigid material, such as plastic.

The upper jaw 202 and the lower jaw 204 may be pivotably coupled to one another adjacent a first end 210 thereof via a hinge assembly 214. The hinge assembly 214 may be a butt hinge, a spring-loaded hinge (configured to bias the clamp 200 in an open or closed configuration), a concealed hinge, an overlay hinge, a hidden barrel hinge, a knife hinge, a pin assembly, or other mechanism configured to pivotably couple the upper and lower jaws 202, 204. The second ends 212*a*, 212*b* (collectively, 212) of the upper and lower jaw 202, 204 may move away from one another to allow the lower jaw 204 to be positioned behind a backpack strap and the upper jaw 202 to be positioned along a front of the same backpack strap. When closed, the upper and lower jaws 202, 204 may define a cavity 216 configured to receive the backpack strap therein. The cavity 216 may have a length 218 that is less than the length 208 of the clamp 200. In some cases, the length 218 of the cavity 216 may be in the range of about of about 2 inches (5.08 cm) to about 3 inches (7.62 cm) or about 2.5 inches (6.35 cm).

The clamp 200 may further include a deflectable clasp 220 coupled to the lower jaw 204 adjacent the second end thereof 212*b*. In some cases, the deflectable clasp 220 may be formed as a single monolithic structure with the lower jaw 204. The deflectable clasp 220 may include a curved flex region 222 configured to allow an upper end 224 of the clasp 220 to be bent or deformed away from the upper jaw 202 as generally shown at arrow 226. The clasp 220 may be selectively positionable over the upper jaw 202 (as shown in FIG. 8) to maintain the clamp 200 in the closed configuration. In some cases, the upper jaw 202 may include a recess or groove 228 configured to receive an edge of the clasp 220. This may provide a mechanical stop which reduces inadvertent movement of the clasp 220. The upper end 224 of the clasp 220 may include a curved upper gripping region 230 which may be configured to facilitate actuation of clasp 220. The upper end of 224 of the clasp 220 may include a sloped surface 232 configured to slide along the recess 228 of the upper jaw 202 upon deflection of the clasp 220 while maintaining a mechanical lock when the clamp 200 is in the locked configuration.

The clamp 200 may further include a first plurality of teeth or protrusions 234 extending from the upper jaw 202 and a second plurality of teeth or protrusion 236 extending from the lower jaw 204. The first plurality of teeth 234 may extend from a lower surface 238 of the upper jaw 202 towards the lower jaw 204 while the second plurality of teeth 236 may extend from an upper surface 240 of the lower jaw 204 towards the upper jaw 202. In some cases, each tooth of the first plurality of teeth 234 may be offset from each tooth of the second plurality of teeth 236. However, this is not required. It is contemplated that the first and/or second plurality of teeth 234, 236 may be arranged in any manner desired. For example, the first and/or second plurality of teeth 234, 236 may be arranged in one or more rows and/or one or more columns along the surfaces 238, 240 of the upper and lower jaws 202, 204. It is further contemplated that the first plurality of teeth 234 and the second plurality of teeth 236 may include a same number of individual teeth or a differing number of teeth, as desired. In some cases, only one of the first plurality of teeth or the second plurality of teeth 236 may be provided. While the first and second plurality of teeth 234, 236 are illustrated as having a triangular, conical or pyramidal shape, it is contemplated that the first and second plurality of teeth 234, 236 may take any shape desired. The first and second plurality of teeth 234, 236 may be configured to grip the fabric of a backpack strap without causing damage to the strap. In some cases, the first and second plurality of teeth 234, 236 may include combinations of teeth shapes and/or sizes.

The clamp 200 may additionally include a protrusion 242 extending upwardly from an upper surface 244 of the upper jaw 202. The protrusion 242 may define an aperture or opening 246 configured to receive a strap 250 (see, for example, FIGS. 10-11) for coupling the clamp 200 to an insertion member 252 of a buckle and in turn to the child carrier 10, 300. The strap 250 may be a length of material that is looped through the aperture 246 and through an aperture 254 in the insertion member 252. The free ends of the strap 250 may be secured to one another via a heavy duty thread, fusible tape, fusible web, adhesives, rivets, etc. to define a continuous loop. Alternatively, each free end may be secured to the strap 250 adjacent to the aperture 246, 254 through which the free end is looped.

The strap 250 may be formed, at least in part, from a nylon webbing strap. However, other webbing strap may be used as desired, including, but not limited to polypropylene, polyester, and/or Kevlar®. It is further contemplated that other heavy-duty fabrics, such as those described above, may be used in place of a webbing strap, if so desired. The strap 250 may have a width of about 1 inch (2.54 cm). However, the width can be less than 1 inch (2.54 cm) or greater than 1 inch (2.54 cm), as desired.

The clamp 200 may be configured to pinch or otherwise secure the backpack strap within the cavity 216 of the clamp 200 in similar manner to that shown in FIG. 7. Further, the clamp may be secured to the carrier 10, 300 via a strap and buckle assembly (FIG. 10) or a cord assembly (FIGS. 1 and 7). This may allow the clamp 200 to function as the anchor to the backpack. For example, in lieu of the second strap portions 38 being disposed around upper shoulder strap adjuster of a backpacking backpack (as illustrated in FIG. 3), the second strap portions 38 are secured to the backpack strap via the clamp 200 and insertion member 252. This may allow the child carrier 10 to be used with any style of backpack regardless of the presence of upper shoulder strap adjusters.

Figure 11:
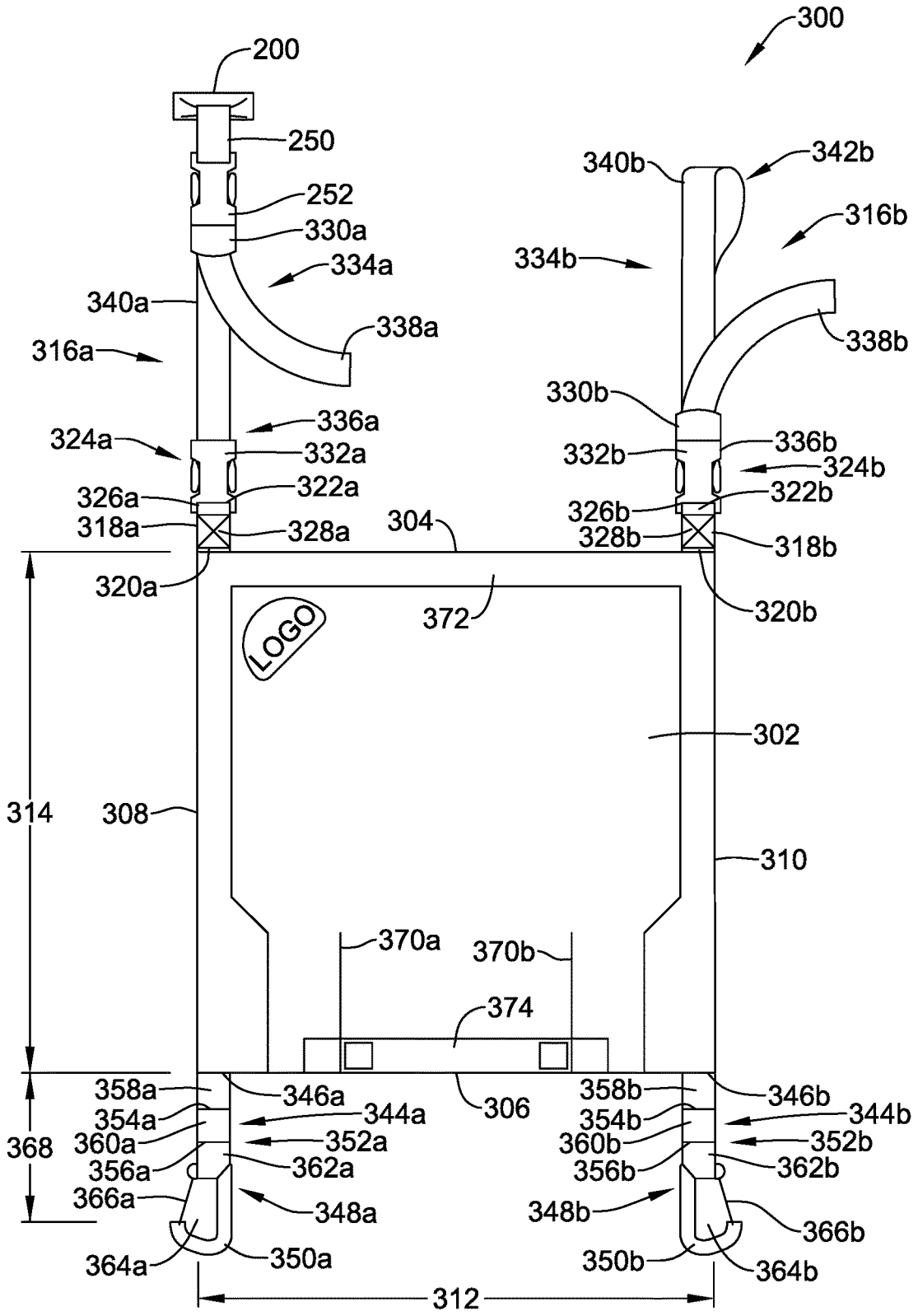
FIG. 11 is a front view of another illustrative child carrier.

FIG. 11 is a front view of another illustrative child carrier 300. The child carrier 300 includes a flexible body portion or panel 302 extending from a top end 304 to a bottom end 306 and between a first lateral side 308 and a second lateral side 310. The body portion 302 may be substantially free from openings. The body portion 302 may have a generally square shape. However, this is not required. Other shapes may be used as desired. For example, a width 312 of the body portion 302 may be varied along a height 314 such that the width 312 is smaller adjacent the bottom end 306 than adjacent the top end 304. For example, the body portion 302 may include a pair of vertically extending pleats 370*a*, 370*b* configured to reduce the width 312 adjacent to the bottom end 306. This is just one example. The shape may be varied as desired to accommodate a child's size. In some cases, the body portion 302 may have a width 312 that is in the range of about 10 inches (25.4 centimeters (cm)) to about 20 inches (344.8 cm), or about 15 inches (334.1 cm). In some cases, the body portion 302 may have a height 314 that is in the range of about 10 inches (25.4 centimeters (cm)) to about 20 inches (344.8 cm), or about 15 inches (334.1 cm). There are just examples; the width 312 and/or height 314 may be less than 10 inches (25.4 cm) or greater than 20 inches (344.8 cm), as desired. The child carrier 300 may be foldable or compressible such that it can be easily transported when not in use.

The body portion 302 may be formed from a heavy weight fabric, such as, but not limited to, canvas, denim, corduroy, ottoman fabric, upholstery fabric, wool, wool tweed, chenille, fleece, coated fabrics, etc. In some cases, the body portion 302 may be treated to be water resistant, waterproof, and/or abrasion resistant, etc. It is further contemplated that the body portion 302 may be formed from other materials, such as nylon, polyester, etc. In FIG. 11, the child carrier 300 is illustrated with a generally planar body portion 302 however, in use the bottom end 306 may curve underneath the child the support the bottom, as will be described in more detail herein. In some cases, the body portion 302 may be formed from a single unitary piece of fabric. In other cases, the body portion 302 may be formed from two or more pieces of fabric sewn together. In some embodiments, the top end 304 and/or the bottom end 306 may be reinforced with a strip of nylon webbing 372, 374. However, other webbing strap may be used as desired, including, but not limited to polypropylene, polyester, and/or Kevlar®. It is further contemplated that other heavy-duty fabrics, such as those described above, may be used in place of a webbing strip 372, 374, if so desired. The webbing strips 372, 374 may have a width of about 1 inch (2.54 cm). However, the width can be less than 1 inch (2.54 cm) or greater than 1 inch (2.54 cm), as desired.

The body portion 302 include a first upper strap assembly 316*a* and a second upper strap assembly 316*b* (collectively, 316) fixedly secured to the top end 304 of the body portion 302. The first upper strap assembly 316*a* may be secured adjacent to the top end 304 adjacent to the first lateral side 308. While FIG. 11 illustrates the first upper strap assembly 316*a* as being in line with the first lateral side 308, this is not required. The first upper strap assembly 316*a* may be laterally offset from the first lateral side 308, as desired. Similarly, the second upper strap assembly 316*b* may be secured adjacent to the top end 304 adjacent to the second lateral side 310. While FIG. 11 illustrates the second upper strap assembly 316*b* as being in line with the second lateral side 310, this is not required. The second upper strap assembly 316*b* may be laterally offset from the second lateral side 310, as desired.

Each of the upper strap assemblies 316 may include a first strap portion 318*a*, 318*b* (collectively, 318) having a first end 320*a*, 320*b* (collectively, 320) secured to the body portion 302 and a second end 322*a*, 322*b* (collectively, 322) coupled to a buckle 324*a*, 324*b* (collectively, 324). The first strap portion 318 may have a length of material that is looped through an opening or slot 326*a*, 326*b* (collectively, 326) of the buckle 324 such that both free ends of the length are adjacent to the first end 320 of the first strap portion 318 and the second end 322 is movably coupled to the buckle 324. In some cases, the first end 320 (e.g., both free ends of the length of the material) of the first strap portion 318 may be sewn to the body portion 302, using, for example, heavy duty thread. In other cases, the first end 320 of the first strap portion 318 may be secured to the body portion 302 using other techniques, such as, but not limited to, fusible tape, fusible web, adhesives, rivets, etc. It is contemplated that more than one coupling mechanism may be used in combination to secure the upper strap assemblies 316 to the body portion 302. In some cases, the first strap portion 318 may be secured to itself using a box stitch 328*a*, 328*b* (collectively, 328). For example, when both free ends of the length are adjacent to the first end 320 of the first strap portion 318, an intermediate region where the first strap portion 318 is doubled back on itself may be secured with the box stitch 328 for reinforcement and/or to limit movement of the second end 322 of the first strap portion 318. It is contemplated that other coupling mechanisms may be used as desired, such as, but not limited to, other stitches, fusible tape, fusible web, adhesives, rivets, etc.

The buckle 324 may be a side release buckle 324 having a first or hook end 330*a*, 330*b* (collectively, 330) and a second or an insertion end 332*a*, 332*b* (collectively, 332). The hook end 330 is releasably secured within the insertion end 332. In FIG. 11, the first buckle 324*a* is illustrated in an uncoupled configuration relative to the first insertion end 332 while the second buckle 324*b* is in the coupled configuration. However, the first hook end 330*a* of the first buckle 324*a* is coupled with a second insertion end 252, as will be described in more detail herein. While the buckle 324 is described as a side release buckle, other buckles or fastening mechanisms may be used as desired, such as, but not limited to, conventional belt buckles, clasps, etc.

The upper strap assemblies 316 may further include a second strap portion 334*a*, 334*b* (collectively, 334) extending from a first end 336*a*, 336*b* (collectively, 336) and a second end 338*a*, 338*b* (collectively, 338). In some examples, the first end 336 of the second strap portion 334 may be fixedly secured to the insertion end 332 of the buckle 324 (e.g., looped through the slot 326 and sewn to itself). In other examples, the first end 336 of the second strap portion 334 may be fixedly secured to the body portion 302. It is contemplated that when the first end 336 is secured to the body portion 302, the first end 336 may be sewn to the body portion 302 or attached using any of the other mechanisms described herein. The second end 338 may be movably secured to the hook end 330 of the buckle 324 and/or to an intermediate region 340*a*, 340*b* (collectively, 340) of the second strap portion 334 to shorten or lengthen the second strap portion 334. For example, the second end 338 may be movably secured to the intermediate region 340 via a tri-glide slide or a webbing slide to shorten or lengthen a length of the second strap portion 334.

When the hook end 330 is secured within the insertion end 332 of the buckle 324, the second strap portion 334 may form a loop 342*b*. The loop 342*b* may be configured to be attached or wrapped around the upper shoulder strap adjuster of a backpacking backpack, as will be described in more detail herein, to releasably secure the child carrier 300 to the backpacking backpack. In the illustrated embodiment, the hook end 330*a* is not secured within the insertion end 332*a* of the first buckle 324*a*. However, it should be understood that when the hook end 330*a* is not secured within the insertion end 332*a* of the first buckle 324*a*, a loop similar to loop 342*b* is formed to attach to or wrap around the upper shoulder strap adjuster of a backpacking backpack In some cases, it may be desirable to couple the child carrier 300 to a backpack that does not include upper shoulder strap adjusters, such as, but not limited to, a daypack. Optional and/or removable clamps or clasps 200 may be coupled to the hook ends 330 of the buckles 324 to secure the child carrier 300 to a strap of a daypack, as shown at the first upper strap assembly 316*a*. While FIG. 11 illustrates a single clamp 200, it should be understood that a clamp 200 may be releasably secured to each of the hook ends 330*a*, 330*b*. The clamp 200 may be releasably secured to the second strap portions 334 using an insertion end 252 of a buckle. The clamp 200 may be secured to the insertion end 252 via a strap 250, such as, but not limited to, a length of nylon webbing. For example, as described herein, the strap 250 may be secured to the clamp 200 and then secured to the insertion end 252. It is contemplated that the strap 250 may form a loop with the free ends secured using a heavy duty thread, fusible tape, fusible web, adhesives, rivets, etc.

The body portion 302 include a first lower strap assembly 344*a* and a second lower strap assembly 344*b* (collectively, 344) fixedly secured to the bottom end 306 of the body portion 302. The first lower strap assembly 344*a* may be secured adjacent to the bottom end 306 adjacent to the first lateral side 308. While FIG. 11 illustrates the first lower strap assembly 344*a* as being in line with the first lateral side 308, this is not required. The first lower strap assembly 344*a* may be laterally offset from the first lateral side 308, as desired. Similarly, the second lower strap assembly 344*b* may be secured adjacent to the bottom end 306 adjacent to the second lateral side 310. While FIG. 11 illustrates the second lower strap assembly 344*b* as being in line with the second lateral side 310, this is not required. The second lower strap assembly 344*b* may be laterally offset from the second lateral side 310, as desired.

Each of the lower strap assemblies 344 may include a first end 346*a*, 346*b* (collectively, 346) secured to the bottom end 306 of the body portion 302 and a second end 348*a*, 348*b* (collectively, 348) spaced from the first end 346 and free from attachment to the body portion 302. The lower strap assemblies 344 may further include a coupling mechanism 350*a*, 350*b* (collectively, 350), such as, but not limited to a carabiner clip, releasably secured thereto. In some cases, the first end 346 of the lower strap assemblies 344 may be sewn to the body portion 302, using, for example, heavy duty thread. In other cases, the first end 346 of the lower strap assemblies 344 may be secured to the body portion 302 using other techniques, such as, but not limited to, fusible tape, fusible web, adhesives, rivets, etc. It is contemplated that more than one coupling mechanism may be used in combination to secure the lower strap assemblies 344 to the body portion 302. The lower strap assemblies 344 may be folded back on itself to create a loop 352*a*, 352*b* (collectively, 352) with both free ends secured to the body portion 302. The lower strap assemblies 344 may have a length of about 10 inches (25.4 cm) such that the loops 352 have a length 368 of about 5 inches (12.7 cm). However, the strap assemblies 344 may have a length of less than 10 inches (25.4 cm) or greater than 10 inches (25.4 cm), as desired. Each loop 352 may stitched or tacked together at two or more locations 354*a*, 354*b*, 356*a*, 356*b* such that each lower strap assembly 344 defines a first loop 358*a*, 358*b* (collectively, 358), a second loop 360*a*, 360*b* (collectively, 360), and a third loop 362*a*, 362*b* (collectively, 362) between the first and second ends 346, 348. The loops 358, 360, 362 may be formed to each have a same length or differing lengths, as desired. While the lower strap assemblies 344 are illustrated as including three loops 358, 360, 362, it is contemplated that fewer than three loops (e.g., one or two) or more than three loops (e.g., four, five, six, or more) may be provided by adjusting a number of stitch or tack locations. The user may adjust a length of the lower strap assemblies 344 by securing the coupling mechanism 350 to a desired loop. For example, securing the coupling mechanism 350 to the first loop 358 will provide a shorter lower strap assembly 344 while securing the coupling mechanism to the third loop 362 will provide a longer lower strap assembly 344. It is contemplated that when the coupling mechanism 350 is disposed within the first or second loops 358, 360, the coupling mechanism 350 may be spaced from the second end 348 of the lower strap assembly 344.

The coupling mechanism 350 may be configured to receive a portion of the loop 352 (e.g., one of the three loops 358, 360, 362) within a central opening 364*a*, 364*b* (collectively, 364) thereof. For example, the coupling mechanism 350 may include an articulatable portion 366*a*, 366*b* (collectively, 366) which is configured to deflect to allow the coupling mechanism to be clipped to various components. When the child carrier 300 is coupled to a backpacking backpack, daypack, or other backpack, the coupling mechanism 350 may also receive a portion of the backpack strap within the central opening 364.

The upper and/or lower strap assemblies 316, 344 may be formed, at least in part, from a nylon webbing strap. However, other webbing strap may be used as desired, including, but not limited to polypropylene, polyester, and/or Kevlar®. It is further contemplated that other heavy-duty fabrics, such as those described above, may be used in place of a webbing strap, if so desired. The upper and/or lower strap assemblies 316, 344 may have a width of about 1 inch (2.54 cm). However, the width can be less than 1 inch (2.54 cm) or greater than 1 inch (2.54 cm), as desired.

The child carrier 300 may be secured to a backpacking backpack in a manner similar to that described above with respect to FIGS. 2 and 3. To couple the child carrier 300 to a backpacking backpack the buckles 324 may be unbuckled to allow the hook end 330 to move freely. The hook end 330 may be wrapped around the upper shoulder strap adjuster of the strap of the backpacking backpack adjacent to the wearer's shoulder. The hook end 330 may then be coupled with the insertion end 332 of the buckle 324 to secure each upper strap assembly 316 to the backpacking backpack. The looped portion 342 of each second strap portion 334 of the upper strap assembly 316 is disposed above the upper shoulder strap adjuster such that the upper shoulder strap adjuster acts as mechanical stop preventing downward movement of the child carrier 300. Similarly, the coupling mechanism 350 may be secured about a lower portion of the strap of the backpacking backpack adjacent to the person's waist.

The length of the upper strap assemblies 316 and/or the length of the lower strap assemblies 344 may be increased or decreased to accommodate the size of the child and/or the size of the person carrying the child. In some cases, the length of the lower strap assembly 344 may be adjusted to bring the bottom end 306 of the body portion 302 closer to the wearer's body by positioning the coupling mechanism 350 through a desired loop 358, 360, 362 while the upper strap assembly 316 may be adjusted such that there is a gap between the wearer's body and the top end 304. It is contemplated that as the bottom end 306 of the body portion 302 of the child carrier 300 is drawn toward the body of the wearer, a seat region is created to allow the bottom of the child to rest therein. The legs of the child may extend over the lower strap assemblies 344 to rest comfortably alongside the person carrying the child. It is further contemplated that the body portion 302 supports the back of the child.

Figure 12:
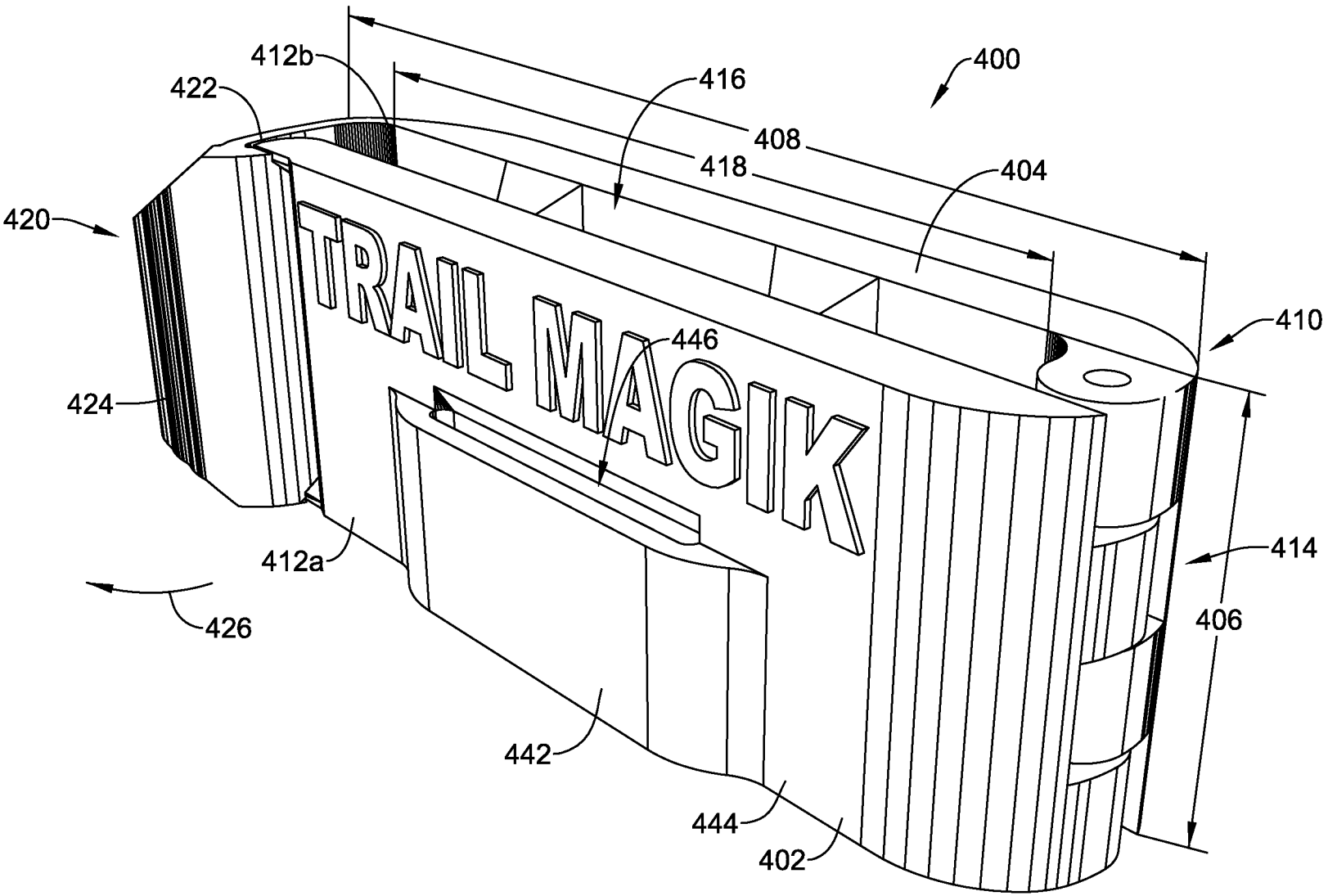
FIG. 12 is a perspective view of another illustrative clamp for use with a child carrier in a closed configuration.
Figure 13:
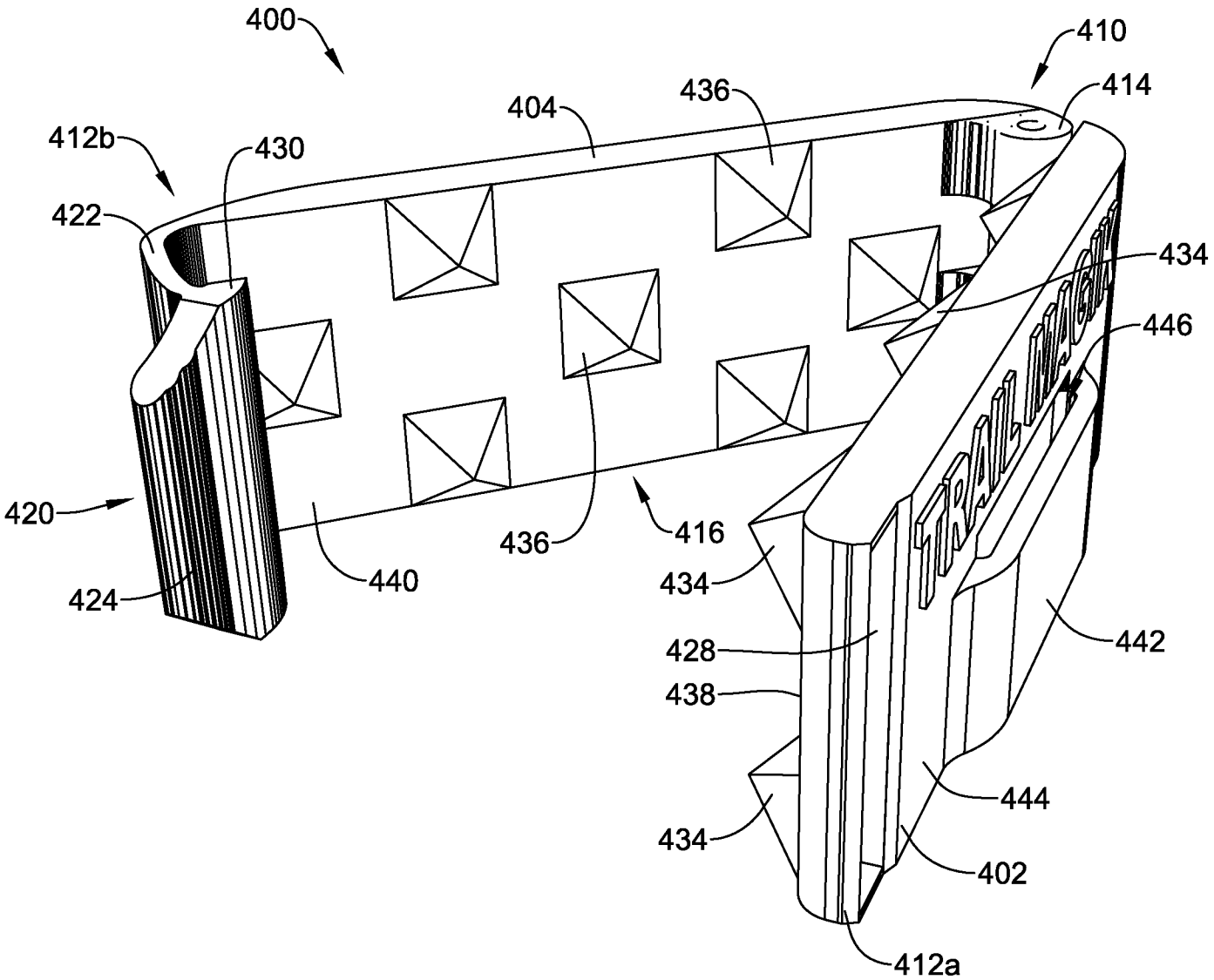
FIG. 13 is a perspective view of the illustrative clamp of FIG. 12 in an open configuration.

FIG. 12 is a perspective view of another illustrative strap clamp 400 in a closed configuration that may be used to secure the child carrier 10 to a backpack that is free from an upper shoulder strap adjuster. FIG. 13 is a perspective view of the illustrative strap clamp 400 of FIG. 12 in an open configuration. While the clamp 400 is described with respect to securing the child carrier 10 to a backpack, it is contemplated that the clamp 400 may be used to secure other accessory devices to a strap of a backpack (or other piece of equipment). For example, the clamp 400 may be used to secure accessories such as, but not limited to, water bottles, binoculars, cell phones, hiking gear, camping gear, etc.

Generally, the clamp 400 may include an upper jaw 402 and a lower jaw 404 having a width 406 and a length 408. The clamp 400 may have a generally rectangular shape, as illustrated. However, the clamp 400 may take any shape desired, including, but not limited to, circular or semi-circular, square, triangular, half-ovoid, polygonal, etc. In some cases, the width may be in the range of about 0.5 inches (1.27 cm) to about 1.5 inches (3.81 cm), or about 1 inch (2.54 cm). The length 408 may be in the range of about 2.5 (6.35 cm) inches to about 3.5 inches (8.89 cm) or about 3 inches (7.62 cm). The upper and lower jaws 402, 404 may have similar outer dimensions to provide a uniform outer surface. In some examples, the upper and/or lower jaws 402, 404 of the clamp 400 and/or the various components thereof may be made from a rigid material (e.g., plastic such as acrylonitrile butadiene styrene, thermoplastics, other polymers, hard rubber, metal, alloy, wood). Other examples may, however, include clamps 400 made from a flexible or semi-rigid material, such as plastic.

The upper jaw 402 and the lower jaw 404 may be pivotably coupled to one another adjacent a first end 410 thereof via a hinge assembly 414. The hinge assembly 414 may be a butt hinge, a spring-loaded hinge (configured to bias the clamp 400 in an open or closed configuration), a concealed hinge, an overlay hinge, a hidden barrel hinge, a knife hinge, a pin assembly, or other mechanism configured to pivotably couple the upper and lower jaws 402, 404. The second ends 412*a*, 412*b* (collectively, 412) of the upper and lower jaw 402, 404 may move away from one another to allow the lower jaw 404 to be positioned behind a backpack strap and the upper jaw 402 to be positioned along a front of the same backpack strap. When closed, the upper and lower jaws 402, 404 may define a cavity 416 configured to receive the backpack strap therein. The cavity 416 may have a length 418 that is less than the length 408 of the clamp 400. In some cases, the length 418 of the cavity 416 may be in the range of about of about 2 inches (5.08 cm) to about 3 inches (7.62 cm) or about 2.5 inches (6.35 cm).

The clamp 400 may further include a deflectable clasp 420 coupled to the lower jaw 404 adjacent the second end thereof 412*b*. In some cases, the deflectable clasp 420 may be formed as a single monolithic structure with the lower jaw 404. The deflectable clasp 420 may include a curved flex region 422 and a gripping region 424 configured to allow the clasp 420 to be bent or deformed away from the upper jaw 402 as generally shown at arrow 426. The clasp 420 may be selectively positionable over the upper jaw 402 (as shown in FIG. 12) to maintain the clamp 400 in the closed configuration. In some cases, the upper jaw 402 may include a recess or detent 428 configured to receive an edge 430 of the clasp 420. The edge 430 of the clasp 420 may extend along a length of the detent 428 to reduce inadvertent movement of the clasp 420. The upper end 424 of the clasp 420 may include a curved upper gripping region 424 which may be configured to facilitate actuation of clasp 420. The edge 430 of the clasp 420 may be configured to slide along the detent 428 of the upper jaw 402 upon deflection of the clasp 420 while maintaining a mechanical lock when the clamp 400 is in the locked configuration.

The clamp 400 may further include a first plurality of teeth or protrusions 434 extending from the upper jaw 402 and a second plurality of teeth or protrusion 436 extending from the lower jaw 404. The first plurality of teeth 434 may extend from a lower surface 438 of the upper jaw 402 towards the lower jaw 404 while the second plurality of teeth 436 may extend from an upper surface 440 of the lower jaw 404 towards the upper jaw 402. In some cases, each tooth of the first plurality of teeth 434 may be offset from each tooth of the second plurality of teeth 436. However, this is not required. It is contemplated that the first and/or second plurality of teeth 434, 436 may be arranged in any manner desired. For example, the first and/or second plurality of teeth 434, 436 may be arranged in one or more rows and/or one or more columns along the surfaces 438, 440 of the upper and lower jaws 402, 404. It is further contemplated that the first plurality of teeth 434 and the second plurality of teeth 436 may include a same number of individual teeth or a differing number of teeth, as desired. In some cases, only one of the first plurality of teeth or the second plurality of teeth 436 may be provided. While the first and second plurality of teeth 434, 436 are illustrated as having a triangular, conical or pyramidal shape, it is contemplated that the first and second plurality of teeth 434, 436 may take any shape desired. The first and second plurality of teeth 434, 436 may be configured to grip the fabric of a backpack strap without causing damage to the strap. In some cases, the first and second plurality of teeth 434, 436 may include combinations of teeth shapes and/or sizes.

The clamp 400 may additionally include a protrusion 442 extending upwardly from an upper surface 444 of the upper jaw 402. The protrusion 442 may define an aperture or opening 446 configured to receive a strap (not explicitly shown) for coupling the clamp 400 to an insertion member of a buckle and in turn to the child carrier 10, 300. The strap may be similar in form and function to the strap 250 illustrated in FIGS. 10 and 11. The strap may be a length of material that is looped through the aperture 446 and through an aperture in the insertion member of the buckle. The free ends of the strap may be secured to one another via a heavy duty thread, fusible tape, fusible web, adhesives, rivets, etc. to define a continuous loop. Alternatively, each free end may be secured to the strap adjacent to the aperture 446 through which the free end is looped.

The strap 250 be formed, at least in part, from a nylon webbing strap. However, other webbing strap may be used as desired, including, but not limited to polypropylene, polyester, and/or Kevlar®. It is further contemplated that other heavy-duty fabrics, such as those described above, may be used in place of a webbing strap, if so desired. The strap may have a width of about 1 inch (2.54 cm). However, the width can be less than 1 inch (2.54 cm) or greater than 1 inch (2.54 cm), as desired.

The clamp 400 may be configured to pinch or otherwise secure the backpack strap within the cavity 416 of the clamp 400 in similar manner to that shown in FIG. 7. Further, the clamp may be secured to the carrier 10, 300 via a strap and buckle assembly (FIG. 10) or a cord assembly (FIGS. 1 and 7). This may allow the clamp 400 to function as the anchor to the backpack. For example, in lieu of the second strap portions 38 being disposed around upper shoulder strap adjuster of a backpacking backpack (as illustrated in FIG. 3), the second strap portions 38 are secured to the backpack strap via the clamp 400. This may allow the child carrier 10 to be used with any style of backpack regardless of the presence of upper shoulder strap adjusters.

Those skilled in the art will recognize that the present invention may be manifested in a variety of forms other than the specific embodiments described and contemplated herein. Accordingly, departure in form and detail may be made without departing from the scope and spirit of the present invention as described in the appended claims.

What is claimed is:

1. A child carrier, comprising:

a body portion extending from a top end to a bottom end and between a first lateral side and a second lateral side;

a first upper strap assembly fixedly secured to the top end of the body portion adjacent to the first lateral side, the first upper strap assembly configured to be releasably secured to a first backpack strap;

a second upper strap assembly fixedly secured to the top end of the body portion adjacent to the second lateral side, the second upper strap assembly configured to be releasably secured to a second backpack strap;

a first lower strap assembly fixedly secured to the bottom end of the body portion adjacent to the first lateral side, the first lower strap assembly configured to be releasably secured to the first backpack strap; and a second lower strap assembly fixedly secured to the bottom end of the body portion adjacent to the second lateral side, the second lower strap assembly configured to be releasably secured to the second backpack strap;

wherein each of the first upper strap assembly and the second upper strap assembly comprise:

a first strap portion fixedly secured to the top end of the body portion;

a buckle having an insertion end and a hook end configured to be releasably secured within the insertion end, the insertion end secured to the first strap portion; and a second strap portion having a first end fixedly secured relative to the body portion and a second end movably secured to the hook end of the buckle;

wherein each of the first lower strap assembly and the second lower strap assembly comprise:

a first end secured to the bottom end of the body portion;

a second end spaced from the first end;

a plurality of loops formed between the first end and the second end; and a coupling mechanism releasably secured to at least one of the plurality of loops;

wherein when the hook end of the buckle is secured within the insertion end of the buckle, the second strap portion and the first strap portion form a loop, wherein the loop is configured to be wrapped around an upper shoulder strap adjuster of a backpacking backpack.

2. The child carrier of claim 1, wherein a length of the second strap portion is adjustable.

3. The child carrier of claim 1, wherein the body portion is formed from nylon, polyester, canvas, denim, corduroy, ottoman fabric, upholstery fabric, wool, wool tweed, chenille, fleece, and/or coated fabrics.

4. The child carrier of claim 1, wherein the coupling mechanism comprises a carabiner.

5. The child carrier of claim 1, wherein a length of the first and second lower strap assemblies is adjustable.

6. The child carrier of claim 1, wherein the first and second upper strap assemblies are formed, at least in part, from a nylon web.

7. The child carrier of claim 1, wherein the first and second lower strap assemblies are formed, at least in part, from a nylon web.

8. The child carrier of claim 1, further comprising a first clamp removably coupled to the first upper strap assembly and a second clamp removably coupled to the second upper strap assembly.

9. The child carrier of claim 8, wherein the first and second clamp are configured to be secured to a first and a second backpack strap, respectively.

10. A child carrier, comprising:

a body portion formed from a fabric panel and extending from a top end to a bottom end and between a first lateral side and a second lateral side;

a first upper strap assembly and a second upper strap assembly fixedly secured to the top end of the body portion adjacent to opposing lateral sides of the body portion, each of the first upper strap assembly and the second upper strap assembly comprising:

a first strap portion fixedly secured to the top end of the body portion;

a buckle having an insertion end and a hook end configured to be releasably secured within the insertion end, the insertion end secured to the first strap portion; and a second strap portion having a first end fixedly secured relative to the body portion and a second end movably secured to the hook end of the buckle;

a first lower strap assembly and a second lower strap assembly fixedly secured to the bottom end of the body portion adjacent to opposing lateral sides of the body portion, each of the first lower strap assembly and the second lower strap assembly comprising:

a first end secured to the bottom end of the body portion;

a second end spaced from the first end;

a plurality of loops formed between the first end and the second end; and a coupling mechanism releasably secured to at least one of the plurality of loops;

wherein the first and second upper strap assemblies are configured to be coupled to an upper portion of a first and a second backpack strap, respectively, and the first and second lower strap assemblies are configured to be coupled to a lower portion of the first and the second backpack straps, respectively;

wherein when the hook end of the buckle is secured within the insertion end of the buckle, the second strap portion and the first strap portion form a loop, wherein the loop is configured to be wrapped around an upper shoulder strap adjuster of a backpacking backpack.

11. The child carrier of claim 10, wherein the first lateral side and the second lateral side each include a padded region adjacent to the bottom end.

* * * * *